US007722417B2

(12) United States Patent
Bernloehr et al.

(10) Patent No.: US 7,722,417 B2
(45) Date of Patent: May 25, 2010

(54) TROLLING MOTOR MOUNT WITH MONO MAIN ARM

(75) Inventors: Darrel A. Bernloehr, Mankato, MN (US); Craig E. Turek, St. Peter, MN (US)

(73) Assignee: Johnson Outdoors Inc., Racine, WI (US)

( * ) Notice: Subject to any disclaimer, the term of this patent is extended or adjusted under 35 U.S.C. 154(b) by 158 days.

(21) Appl. No.: 12/074,389

(22) Filed: Mar. 4, 2008

(65) Prior Publication Data

US 2009/0227158 A1 Sep. 10, 2009

(51) Int. Cl.

| | |
|---|---|
| ***B63H 5/20*** | (2006.01) |
| ***B63H 5/125*** | (2006.01) |
| ***B63H 20/08*** | (2006.01) |
| *B60L 11/00* | (2006.01) |
| *B63H 21/17* | (2006.01) |

(52) U.S. Cl. ..... 440/53; 440/6; 440/55

(58) Field of Classification Search ..... 440/6, 440/53, 55, 56, 62–65, 74, 76, 78

See application file for complete search history.

(56) References Cited

U.S. PATENT DOCUMENTS

| | | | | |
|---|---|---|---|---|
| 3,870,258 | A | 3/1975 | Shimanckas et al. | |
| 3,874,318 | A * | 4/1975 | Langley | 440/55 |
| 3,930,461 | A | 1/1976 | Brock et al. | |
| 3,954,080 | A | 5/1976 | Weaver | |
| 3,999,500 | A | 12/1976 | Friedel et al. | |
| 4,008,680 | A | 2/1977 | Alexander, Jr. | |
| 4,129,088 | A | 12/1978 | Foley, Jr. | |
| 4,154,417 | A | 5/1979 | Foley, Jr. | |
| 4,410,161 | A | 10/1983 | Booty | |
| 4,634,390 | A | 1/1987 | Baird | |
| 4,729,745 | A | 3/1988 | Edwards | |
| 4,733,848 | A | 3/1988 | Slattery | |
| 4,819,905 | A | 4/1989 | McCain | |
| 4,966,566 | A | 10/1990 | Baird | |
| 5,112,258 | A | 5/1992 | Folsom | |
| 5,405,274 | A | 4/1995 | Cook, III | |
| 6,224,437 | B1 | 5/2001 | Griffith, Sr. et al. | |
| 6,394,408 | B1 | 5/2002 | Henderson et al. | |
| 6,524,144 | B2 | 2/2003 | Pasley | |
| 6,808,431 | B1 | 10/2004 | Neely | |
| 7,004,804 | B2 | 2/2006 | Bernloehr et al. | |
| 7,195,526 | B2 | 3/2007 | Bernloehr et al. | |
| 7,294,029 | B1 * | 11/2007 | Spaulding | 440/53 |

* cited by examiner

*Primary Examiner*—Daniel V Venne
(74) *Attorney, Agent, or Firm*—Reinhart Boerner Van Deuren P.C.

(57) ABSTRACT

A mount for securing a trolling motor to a watercraft has a base, a main arm, a motor coupling, and a linkage. The motor coupling is configured to rotatably retain the trolling motor. The main arm is pivotally coupled to the base. The linkage is pivotally coupled with the base and the main arm and extends within the main arm to contact the motor coupling for actuating rotation of the motor coupling between a first position when the main arm is in a stowed position, and a second position when the main arm is in a deployed position.

15 Claims, 25 Drawing Sheets

TROLLING MOTOR MOUNT WITH MONO MAIN ARM

BACKGROUND

The present invention relates to trolling motors, and more particularly to a mounting device for securing a trolling motor to a watercraft.

Watercraft, especially fishing boats, often employ a trolling motor. The trolling motor may be used to maneuver or to hold the watercraft in position while the vessel operator fishes. Trolling motors may be interconnected with the watercraft via a mount secured to the bow of the vessel. Often conventional bow mounts include a base plate and several movable arms, which are configured to retain the trolling motor and interlock with the base plate. The movable arms are generally configured to pivot between a stowed position, where the trolling motor is on-board the vessel, and a deployed operation position, where the trolling motor extends into the water.

Although many conventional pivoting bow mounts effectively stow and deploy trolling motors, the durability of the multiple pivoting joints used by the movable arms is limited. After a period of use, the joints of the bow mount may loosen and begin to develop play. This joint play causes the bow mount to rattle or make other unpleasant noises during the operation of the watercraft. With many conventional bow mounts, removing the trolling motor from or attaching the trolling motor to the mount also presents some inconvenience for the operator. This process is inconvenient because the conventional bow mount's actuation rope (which is used to lift and rotate the bow mount's movable arms from the stowed or deployed position) runs through the mount's movable arms and through the portion of the mount that is configured to couple with the trolling motor. In this configuration, the actuation rope must be untied from the interior of the bow mount's movable arms before the portion of the mount that couples with the trolling motor can be removed from the remainder of the mount.

SUMMARY

In one aspect, a mount for securing a trolling motor to a watercraft has a base, a main arm, a motor coupling, and a linkage. The motor coupling is configured to rotatably retain the trolling motor. The main arm is pivotally coupled to the base. The linkage is pivotally coupled with the base and the main arm and extends within the main arm to contact the motor coupling for actuating rotation of the motor coupling between a first position when the main arm is in a stowed position, and a second position when the main arm is in a deployed position.

In another aspect, an apparatus for coupling a trolling motor to a mount includes a motor coupling assembly and a linkage assembly. The motor coupling assembly includes a sleeve configured to couple to the trolling motor. The linkage assembly is configured to interconnect to the mount. The motor coupling assembly and the linkage assembly have male and female interlocking surface profiles.

DETAILED DESCRIPTION

1. Overview of the Assembly 10

Figure 1A:
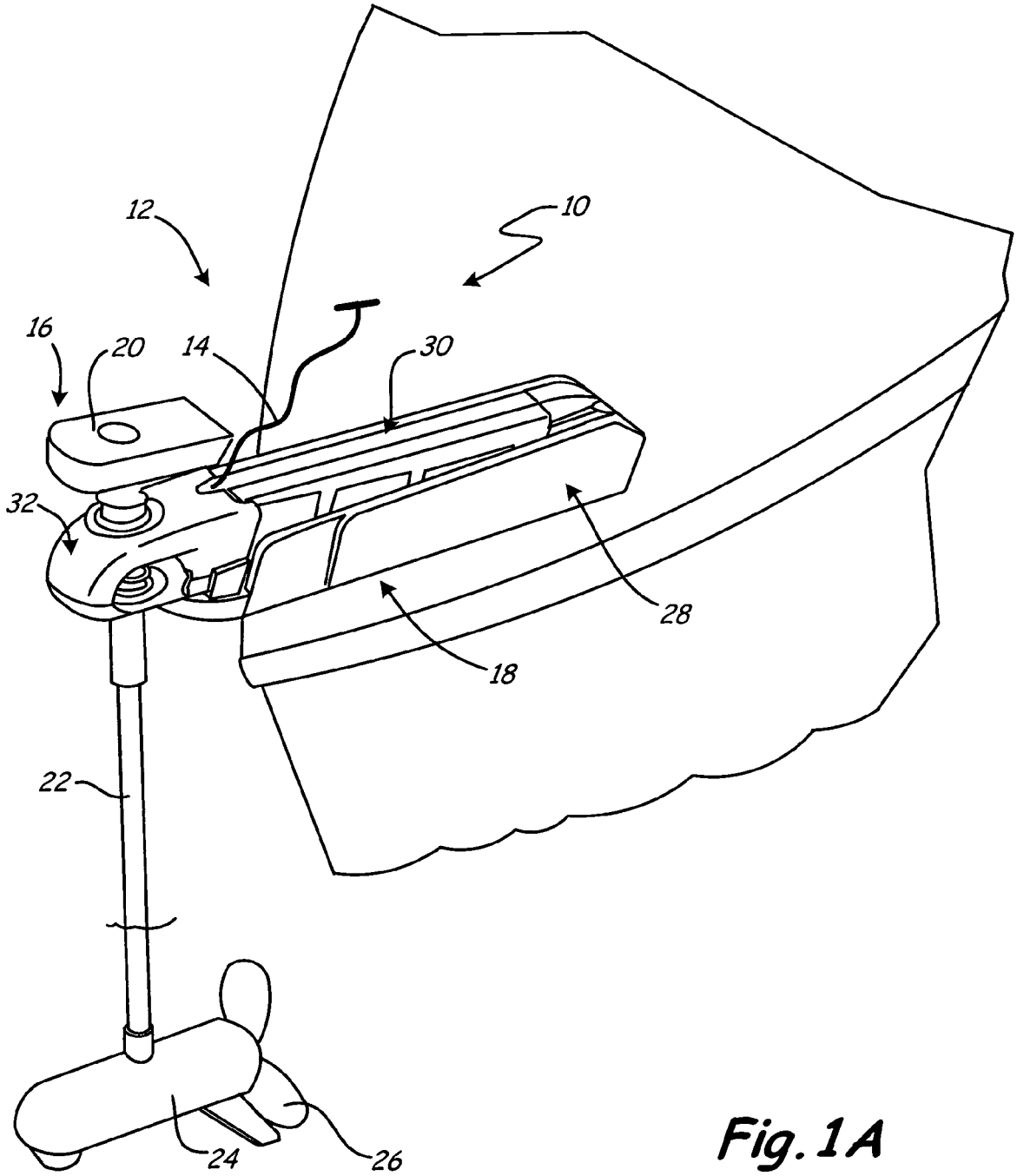
FIG. 1A is a perspective view of an exemplary embodiment of a mount shown in a deployed position securing a trolling motor to the bow of a watercraft.
Figure 1B:
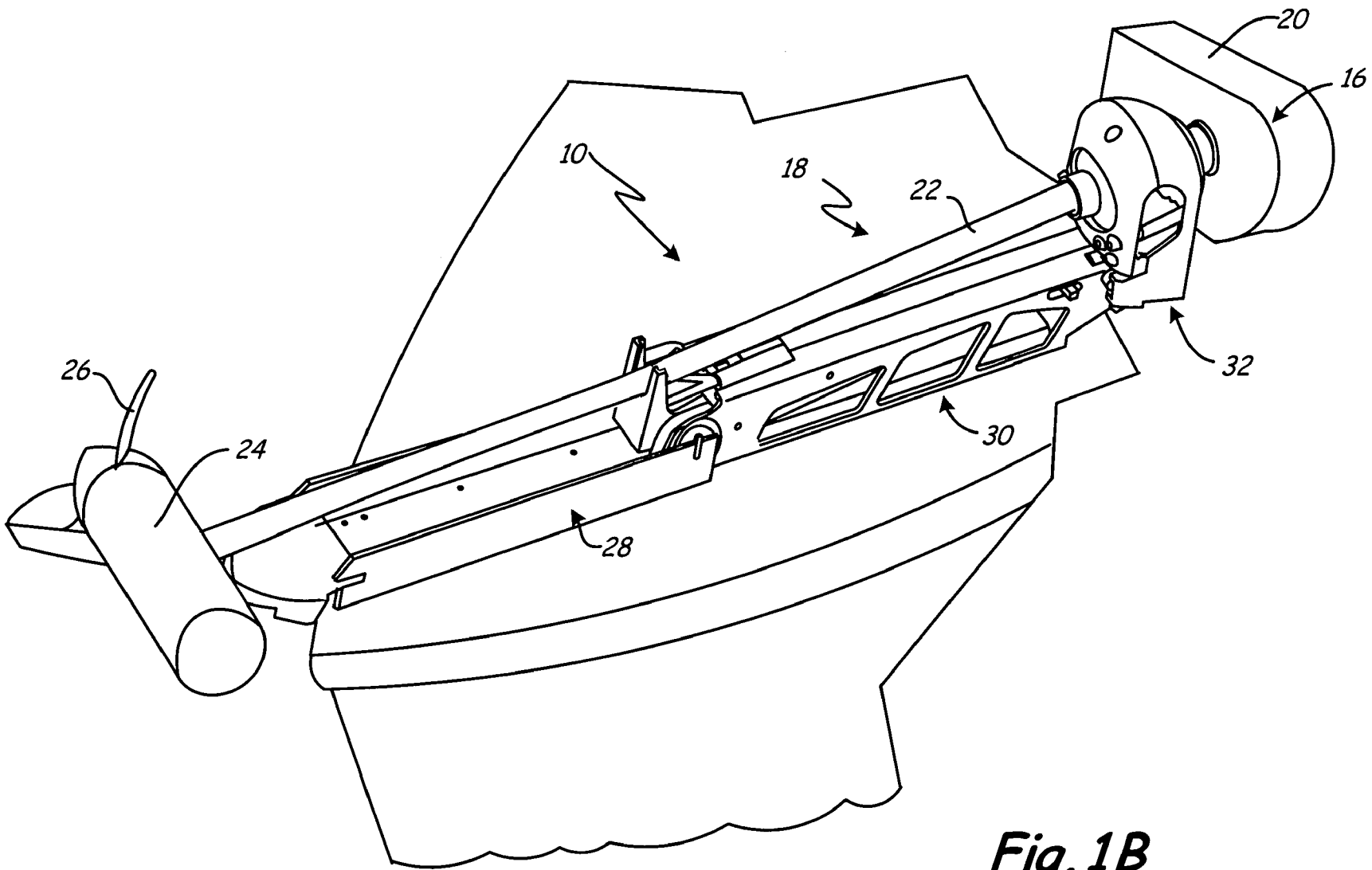
FIG. 1B is a perspective view of the mount from FIG. 1A securing the trolling motor to the bow of a watercraft in a stowed position with base side plates removed.

FIGS. 1A and 1B show an embodiment of a trolling motor assembly 10, which is secured to the gunnels or other suitable surface(s) of a watercraft 12. The trolling motor assembly 10 includes a rope 14, a trolling motor 16, and a mount 18. The trolling motor 16 includes a head 20, a shaft 22, a propulsion unit 24 and a propeller 26. The mount 18 includes a base assembly 28, a main arm assembly 30, and a motor coupling assembly 32.

In FIG. 1A, the trolling motor assembly 10 is shown in the deployed position with the trolling motor 16 entering the water. In FIG. 1B, the trolling motor assembly 10 is shown in the stowed position with the trolling motor 16 retained aboard the watercraft 12, generally parallel with the gunnels of the watercraft 12. In both positions, the trolling motor 16 is secured by the mount 18 to the watercraft 12.

In FIGS. 1A and 1B, the base assembly 28 secures the remainder of the mount 18 and the trolling motor 16 to the watercraft 12. The rear of the main arm assembly 30 pivotally couples with the rear of the base assembly 28. The front of the main arm assembly 28 pivotally couples with the motor coupling assembly 32, which rotatably couples with the shaft 22 of the trolling motor 16. The main arm assembly 30 is adapted to rotate relative to the base assembly 28 between the stowed position and the deployed position. The main arm assembly 30 is configured to releasably latch to the base assembly 28 in the stowed position and in the deployed position. In one embodiment, the rope 14 enters the interior of the main arm assembly 30 and is used by the operator to unlatch the main arm assembly 30 from the base assembly 30 in the stowed position and in the deployed position. In another embodiment, the rope 14 is used to rotate the main arm assembly 30 between the stowed position and the deployed position. Simultaneous with the rotation of the main arm assembly 30 from the stowed position to the deployed position, the main arm assembly 30 is adapted to rotate the motor coupling assembly 32 from a first generally vertical position to a second generally horizontal position. The pivotal rotation of the motor coupling assembly 32 allows the trolling motor 16 to be disposed generally vertically in the water for operational use in deployed position, and allows the trolling motor 16 to be disposed generally horizontal to the gunnels for "non-use" in the stowed position.

In the deployed position illustrated in FIG. 1A, the trolling motor assembly 10 operates to control the velocity and direction of the watercraft 12. The watercraft 12 may be any make, model, or size; and may be a recreational or commercial vessel. To drive the watercraft 12, the propulsion unit 24 must be positioned below the surface of the water. The trolling motor 16 exerts mechanical propulsion by converting electrical current into thrust of the propeller 26 while the propulsion unit 24 is in the water. The shaft 22 is coupled with the mount 18 and the mount 18 is secured to a surface of the watercraft 12. The interconnected components allow the propulsion unit 24 to transfer the thrust of the propeller 26 to the watercraft 12. The trolling motor 16 (and watercraft 12) may be directionally controlled by the operator via a steering mechanism (such as a foot pedal or remote control) or by a handle on the head 20.

2. The Exploded Assembly 18

Figure 2:
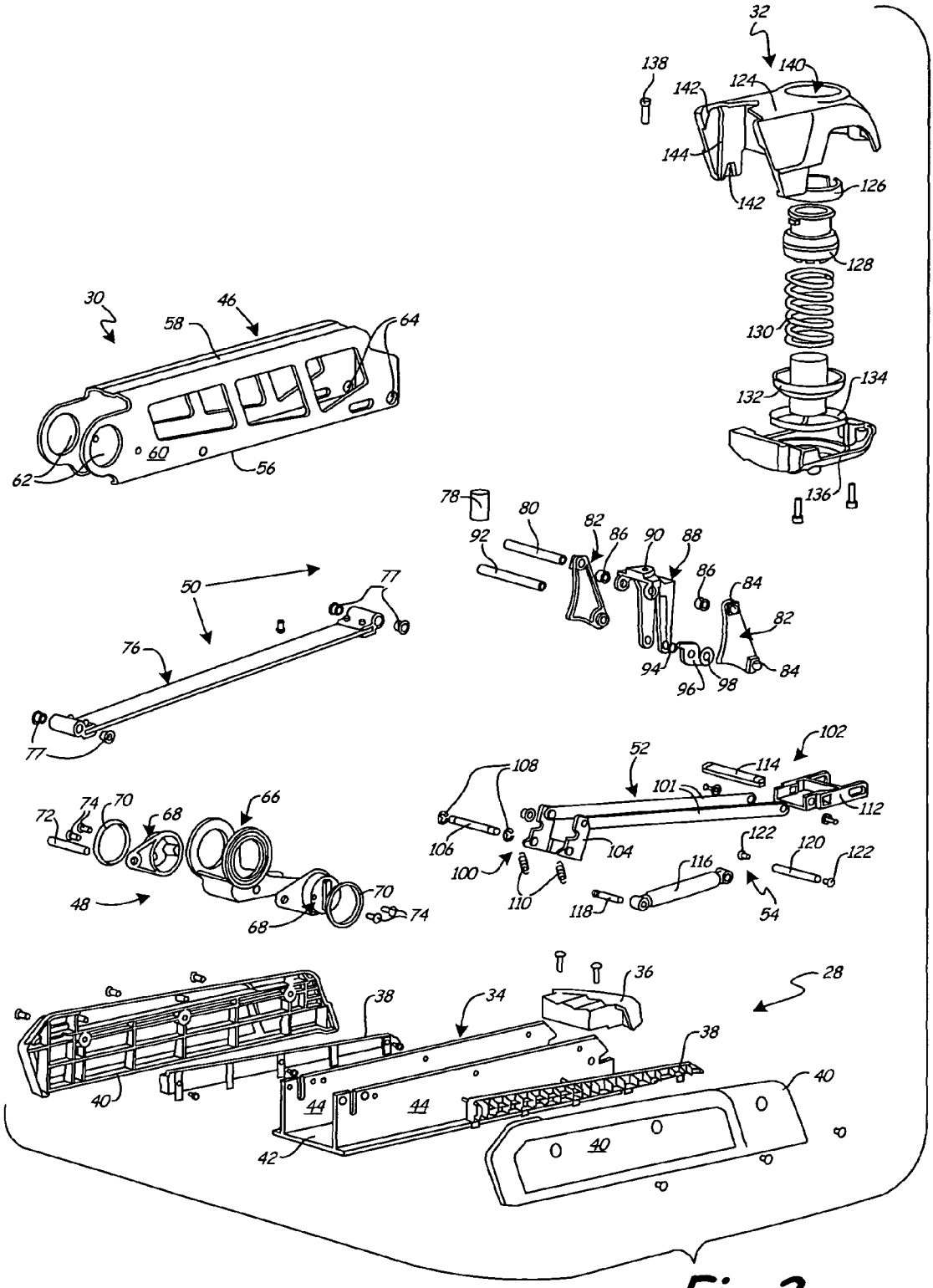
FIG. 2 is an exploded view of the mount from FIG. 1A, viewed from the rear.

FIG. 2 shows an exploded view of an embodiment of the mount 18, viewed from the rear. The base assembly 28 is comprised of a base extrusion 34, a motor ramp 36, side plate supports 38, and side plates 40. The base extrusion 34 includes a base plate 42, and side walls 44.

The main arm assembly 30 includes a main arm 46, a rear pivot mechanism 48, a linkage assembly 50, a latch system 52, and a motion control device 54. The main arm 46 is comprised of a bottom wall 56, a top wall 58, side walls 60, rear pivot mechanism apertures 62, and lower front apertures 64. The rear pivot mechanism 48 includes a yoke 66, rear pivot brackets 68, rear pivot bushings 70, a rear pivot pin 72, and fasteners 74. The linkage assembly 50 includes a leaf spring 76, bushings 77, a leaf spring stop 78, an upper pin 80, front side links 82, linkage projections 84, bushings 86, a rope guide 88, a rope hole 90, a lower pin 92, a torsion spring 94, a safety latch 96, and a washer 98. The latch system 52 includes a rear latch assembly 100, latch straps 101, and a front latch assembly 102. The rear latch assembly 100 includes a rear latch bracket 104, a pivot pin 106, e-clips 108, and extension springs 110. The front latch assembly 102 is comprised of a latch strap bracket 112 and a latch bar 114. The motion control device 54 includes a bias mechanism 116, a rear knurled pin 118, a front pivot pin 120, and fasteners 122.

The motor coupling assembly 32 includes an upper cover 124, an upper bushing 126, an upper sleeve 128, a spring 130, a lower sleeve 132, a lower bushing 134, a lower cover 136 and a fastener 138. The upper cover 124 includes an orifice 140, recesses 142, and tracks 144.

A. Overview of the Exploded Assembly 18

In FIG. 2, the base assembly 28 extends symmetrically from a front portion to a rear portion, and is adapted to be secured to a surface. The rear portion of the base assembly 28 pivotally couples with the main arm 46 via the rear pivot mechanism 48. The open frame rigid main arm 46 extends from a rear portion coupled to the base assembly 28 to a front portion. The linkage assembly 50 is disposed adjacent to (and is pivotally coupled with) the front portion of the main arm 46, and extends through the main arm 46 to pivotally couple to the rear pivot mechanism 48. The linkage assembly 50 and the motor coupling assembly 32 are adapted to removably interconnect. The latch system 52 is disposed inside the frame of the main arm 46 and interconnects to the rear portion of the main arm 46. The latch system 52 extends within the main arm 46 from the rear portion to the front portion where it engages the linkage assembly 50. The main arm 46 is adapted to allow the front portion of the latch system 52 to releasably engage the base assembly 28 in the deployed position, and is adapted to allow the rear portion of the latch system 52 to releasably engage the rear pivot mechanism 48 in the stowed position. The motion control device 54 is disposed within the frame of the main arm 46, and pivotally couples with the main arm 46 and the rear pivot mechanism 48.

In the stowed position, the main arm 46 cantilevers rearward from the rear portion of the base assembly 28. The linkage assembly 50 holds the motor coupling assembly 32 in a generally vertical position so that the trolling motor 16 is disposed generally horizontal to the gunnels. The latch system 52 releasably engages the rear pivot mechanism 48.

Between the stowed position and the deployed position, the main arm 46 pivotally rotates relative to the base assembly 28 on the rear pivot mechanism 48. The linkage assembly 50 actuates pivotal rotation of the motor coupling assembly 32 about the pivot coupling between the main arm 46 and the linkage assembly 50. The linkage assembly 50 pivotally rotates the motor coupling assembly 32 from the generally vertical position when in the stowed position, to a generally horizontal position in the deployed position. The latch system 52 is actuated out of engagement with the base assembly 28 or the rear pivot mechanism 48. The motion control device 54 assists, impedes, or biases the movement of the main arm 46 between the stowed position and the deployed position. The motion control device 54 actuates rotation of a portion of the rear pivot mechanism 48.

In the deployed position, the main arm 46 is received in the U-shaped channel of the base assembly 28. The linkage assembly 50 holds the motor coupling assembly 32 in a generally horizontal position. The latch system 52 releasably engages the front portion of the base assembly 28.

B. Overview of the Exploded Base Assembly 28

In FIG. 2, the base extrusion 34 is a U-shaped channel adapted to be secured to the surface(s) of the watercraft 12. The motor ramp 36 is spade shaped interconnects to the front portion of the base extrusion 34 in a cantilevered fashion. The sides of the base extrusion 34 are adapted to secure to the side plate supports 38 and side plates 40, which extend along the sides of the base extrusion 34 from the front to the rear. The side walls 44 of the base extrusion 34 extend generally vertically from the base plate 42 and are adapted to receive the main arm 46 between them when the main arm 46 is in the deployed position. The rear pivot mechanism 48 secures to the rear portion of the side walls 44.

C. Overview of the Exploded Main Arm 46

In FIG. 2, the bottom wall 56, side walls 60 and top wall 60 interconnect to form the open frame of the main arm 46. The walls 56, 58, 60 extend from the rear portion of the main arm 46 to the front portion. The rear portion of the side walls 60 are adapted to extend further rearward than the bottom wall 56 or the top wall 60. This cantilevered rear portion is adapted with rear pivot mechanism apertures 62, which allow the main arm 46 to rotatably receive the rear pivot mechanism 48. The lower front apertures 64 rotatably receive the linkage assembly 50.

D. Overview of the Exploded Rear Pivot Mechanism 48

FIG. 2 shows the major components of the rear pivot mechanism 48 including the yoke 66. The yoke 66 is symmetrically disposed between the side walls 44 toward the rear portion of the base extrusion 34. The yoke 66 couples with the motion control device 54. The yoke 66 is adapted to receive a hub portion of the rear pivot brackets 68 and to pivotally rotate on this portion. The rear pivot bushings 70 interface with the rear pivot brackets 68 and with the edge of the rear pivot apertures 62. The rear pivot brackets 68 have triangular rearward projections adapted to receive the rear pivot pin 72. The fasteners 74 fix the rear pivot brackets 68 to the side walls 44 of the base extrusion 34.

E. Overview of the Exploded Linkage Assembly 50

In FIG. 2, the leaf spring 76 is adapted to receive the bushings 77, which pivotally couple the leaf spring 76 to the rear pivot pin 72. The leaf spring 76 extends through the interior of the main arm 46 from the rear end to the front end. In one embodiment, the central portion of the leaf spring 76 engages the leaf spring stop 78 when the main arm 46 is in the stowed position. The front portion of the leaf spring 76 is adapted to receive the bushings 77, which pivotally couple the leaf spring 76 to the upper pin 80.

The ends of the upper pin 80 extend into the front side links 82. The linkage projections 84 on the outer side surface of the front side links 82 are adapted to interface and connect the motor coupling assembly 32 to the linkage assembly 50. The bushings 86 receive the upper pin 80 and space the front side links 82 from the rope guide 88. The rope guide 88 rotatably mounts to the upper pin 80 to either side of the leaf spring 76 and is adapted to receive the rope 14 via the rope hole 90.

The front side links 82 and the rope guide 88 extend downward and forward to interconnect to the lower pin 92. The lower pin 92 is received by the lower front apertures 64 of the main arm 46. The lower pin 92 pivotally couples the linkage assembly 50 to the main arm 46. In the front interior portion of the main arm 46, the torsion spring 94, safety latch 96 and washer 98 are configured to receive the lower pin 92. The torsion spring 94 is configured to engage the lower portion of the rope guide 88 and the safety latch 96.

F. Overview of the Exploded Latch System 52

In FIG. 2, the latch system 52 is disposed within the main arm 46. The rear latch assembly 100 is disposed toward the rear portion of the main arm 46. The rear latch assembly 100 pivotally interconnects with the latch straps 101, which extend forward to pivotally interconnect with the front latch assembly 102. More specifically, the upper portion of the rear latch bracket 104 pivotally couples with the latch straps 101. The lower portion the rear latch bracket 104 pivotally couples to the main arm 46 via the pivot pin 106. The e-clips 108 are disposed on the pivot pin 106 interfacing the rear latch bracket 104. The springs 110 interconnect the latch bracket 104 to the bottom surface 56 of the main arm 46.

The latch straps 101 pivotally couple to the latch strap bracket 112. The latch strap bracket 112 is configured to slottedly receive the lower pin 92 at the front portion of the main arm 46. The latch strap bracket 112 is adapted to receive the rope 14, which enters the front interior portion of the main arm 46 through the rope hole 90 in the rope guide 88. The latch strap bracket 112 is adapted to securely receive and interconnect with the latch bar 114, which extends symmetrically through the latch strap bracket 112 and the side walls 60 to releasably engage the front portion of the base extrusion 34 when the main arm 46 is in the deployed position.

G. Overview of the Exploded Motion Control Device 54

FIG. 2 illustrates the major components of the motion control device 40 including the bias mechanism 116, which extends into the main arm 46 from the rear. The rear and front portions of the bias mechanism 116 are adapted to pivotally couple with the rear knurled pin 118 and the front pivot pin 120. The rear knurled pin 118 couples the bias mechanism 116 to the yoke 66. The front pivot pin 120 extends generally horizontally between the side walls 60 of the main arm 46 and couples the bias mechanism 116 to the main arm 46. In one embodiment, the ends of the front pivot pin 120 may be treaded to securely receive fasteners 122, which extend through the side walls 60.

H. Overview of the Exploded Motor Coupling Assembly 32

In FIG. 2, the upper cover 124 extends over and interfaces with the upper bushing 126, and extends around and over a portion of the upper sleeve 128. The upper sleeve 128 rotatably interfaces with the upper bushing 126 and the spring 130. The spring 130 interfaces with the lower sleeve 132. The lower sleeve 132 rotatably interfaces with the spring 130 and the lower bushing 134 and extends through the lower cover 136. The lower cover 136 interconnects with the upper cover 124. In one embodiment, the fastener 138 removably secures the motor coupling assembly 32 to the linkage assembly 50. The sleeves 128, 132 may be adapted to rotatably interface with and couple to the shaft 22 of the trolling motor 16, which is inserted into the interior of the motor coupling assembly 32 through an orifice 140 in the upper cover 124. In another embodiment of the motor coupling assembly 32, the upper cover 124 may include the recesses 142 and/or the tracks 144, which are adapted to interface with and secure the motor coupling assembly 32 to the front side links 82.

3. The Base Assembly 28

Figure 3:
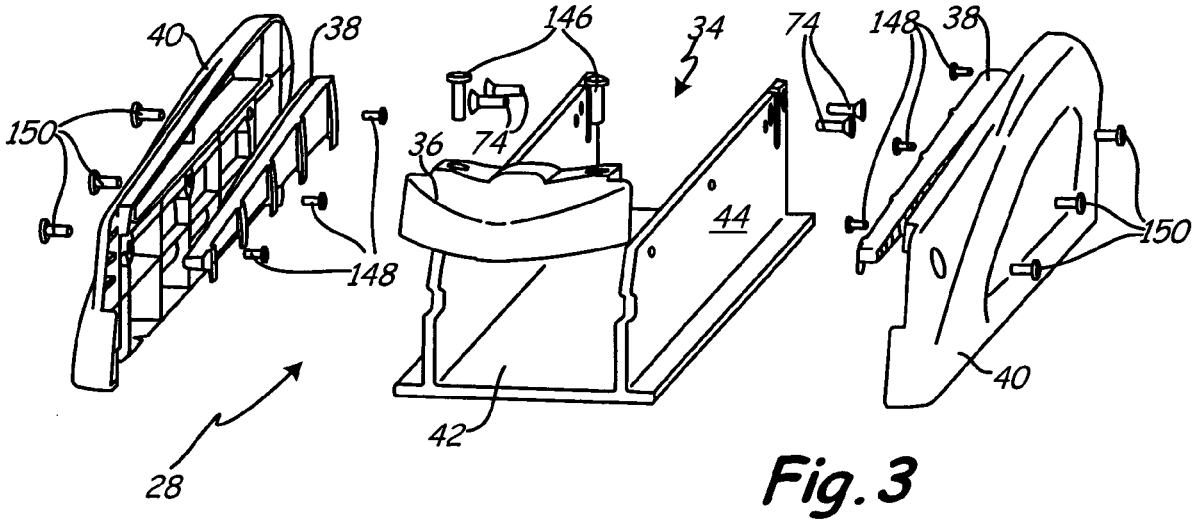
FIG. 3 is an exploded view of the base assembly from FIG. 2, viewed from the front.

FIG. 3 shows an exploded front perspective view of an embodiment the base assembly 28, which includes the base extrusion 34, the motor ramp 36, the side plate supports 38, and the side plates 40. Additionally, the base assembly 28 includes motor ramp fasteners 146, side plate support fasteners 148, and side plate fasteners 150.

In FIG. 3, the base extrusion 34 is a U-shaped channel adapted to be secured to surface(s) such as the gunnels. The motor ramp fasteners 146 secure the motor ramp 36 to the lower front portion of the base extrusion 34. The side walls 44 run along the length of the base extrusion 34. The side walls 44 are adapted to receive the side plate support fasteners 148, which mount the side plate supports 38 to the side walls 44. The side plate supports 38 are adapted to receive the side plate fasteners 150, which mount the side plates 40 to the side plate supports 38. The side plates 40 cover the side surfaces of the base extrusion 34 for cosmetic purposes.

Figure 4A:
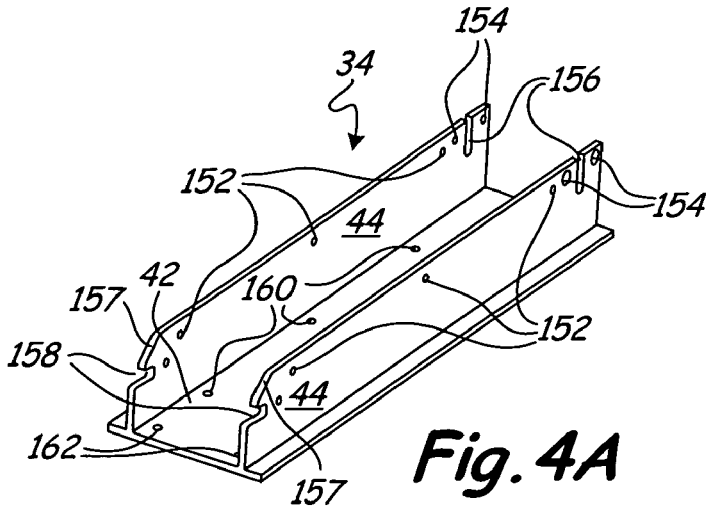
FIG. 4A is a perspective view of the base extrusion from FIG. 2, viewed from the front.
Figure 4B:
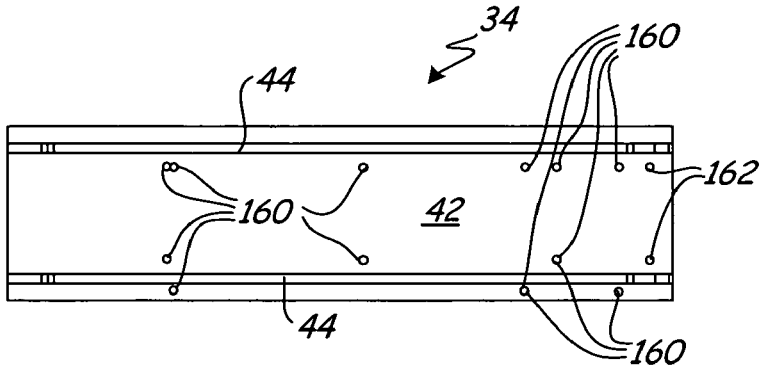
FIG. 4B is a top view of the base extrusion from FIG. 4A.
Figure 4C:
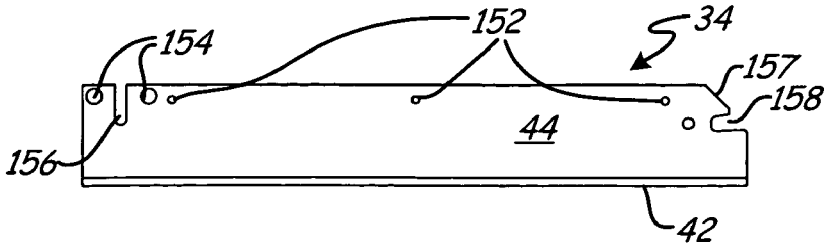
FIG. 4C is a side view of the base extrusion from FIG. 4A.

FIGS. 4A to 4C show different views of an embodiment of the base extrusion 34. In addition to the side walls 44 and the base plate 42, the base extrusion 34 includes side plate support apertures 152, pivot mechanism apertures 154, slots 156, front edges 157, locking notches 158, thru holes 160, and motor ramp apertures 162.

FIGS. 4A to 4C show the two spaced apart side walls 44 that extend generally vertically upward from the base plate 42 and extend generally parallel to one another along the edge of the base plate 42. The side walls 44 define a recess capable of receiving the main arm 46 in the deployed position. In a one embodiment, the side walls 44 are configured with side plate support apertures 152 to receive the side plate support fasteners 148, which mount the side plate supports 38 to the side walls 44.

The countersunk pivot mechanism apertures 154 in the rear portion of the side walls 44 receive the fasteners 74, which secure the rear pivot brackets 68 to the base extrusion 34. Likewise, the slots 156 are configured to receive a projecting portion of the rear pivot brackets 68. The slots 156 retain the rear pivot brackets 68 from pivotally rotating.

The diagonal front edges 157 of the side walls 44 interconnect the top edges of the side walls 44 with the locking notches 158. In one embodiment, each locking notch 158 is disposed at a 7.5 degree angle to the base plate 42. The lower edge of each locking notch 158 extends forward past the forward termination point of the front edges 157. The lower edges of the locking notches 158 are configured to catch the latch bar 114. The angle of the locking notches 158 draws the latch bar 114 into releasable engagement with the locking notches 158 when the main arm 46 is in the deployed position. In other embodiments, means including apertures, recesses, tabs, or slots may be used to engage the main arm 46 with the base assembly 28.

In FIGS. 4A to 4C, the base plate 42 is generally flat for ease of mounting, and rectangular in shape. The base plate 42 extends from a rear end generally near the rear pivot mechanism 48 to a front end, which interconnects with the motor ramp 36. The base plate 42 is configured with thru holes 160, which receive fasteners that secure the trolling motor assembly 10 to the surface of the watercraft 12. The motor ramp apertures 162 extend through the base plate 42 and receive the motor ramp fasteners 146, which secure the motor ramp 36 to the base plate 42.

Figure 5A:
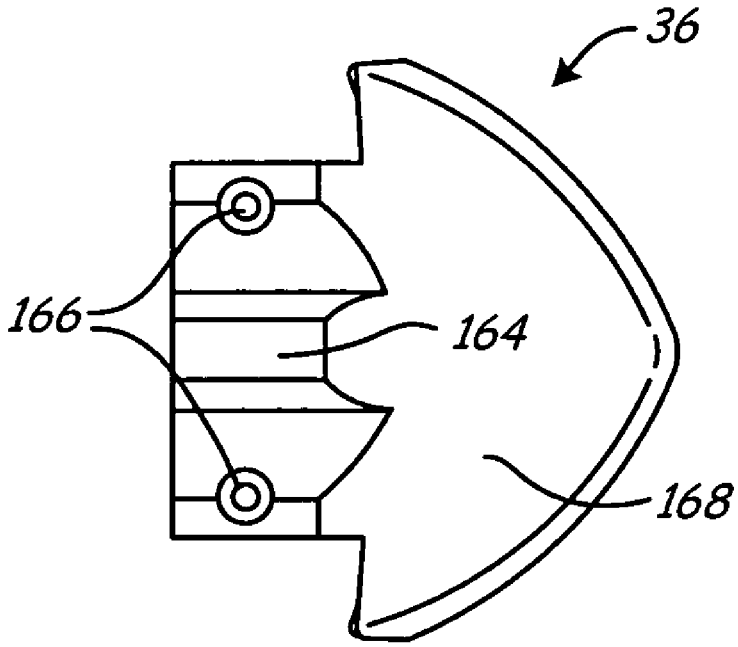
FIG. 5A is a top view of the motor ramp from FIG. 2.
Figure 5B:
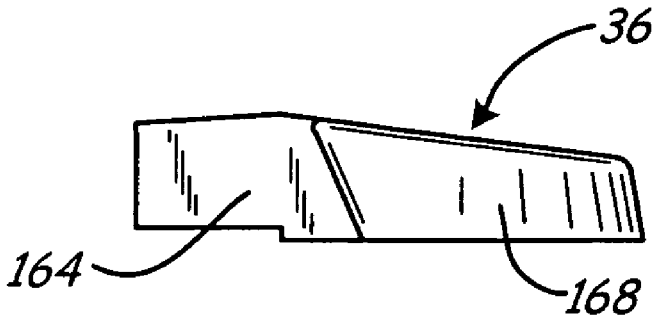
FIG. 5B is a side view of the motor ramp from FIG. 5A.

FIGS. 5A and 5B show an embodiment of the motor ramp 36, which includes a base interconnection portion 164, apertures 166 and a motor engaging portion 168.

The base interconnection portion 164 of the motor ramp 36 is adapted to be inserted on the front portion of the base plate 42 between the side walls 44. The base interconnection portion 164 has apertures 166, which align with the motor ramp apertures 162 when the motor ramp 36 is disposed on the base plate 42. The motor ramp apertures 162 and the apertures 166 receive the motor ramp fasteners 146, which secure the motor ramp 36 to the base plate 42. In one embodiment, when the motor ramp 36 is disposed on the base plate 42, the motor engaging portion 168 cantilevers off the front end of the base plate 42 and over the edge of the watercraft 12. In FIGS. 5A and 5B, the motor engaging portion 168 is spade shaped with two angled surfaces connecting at one forward end point. The motor engaging portion 168 is adapted to rotate the propulsion unit 24 of the trolling motor 16 as the unit 24 comes into contact with the motor ramp 36 at a position between stow and deploy. The motor ramp 36 reduces the likelihood of contact between the propulsion unit 24 and the watercraft 12.

4. The Main Arm Assembly 30

Figure 6:
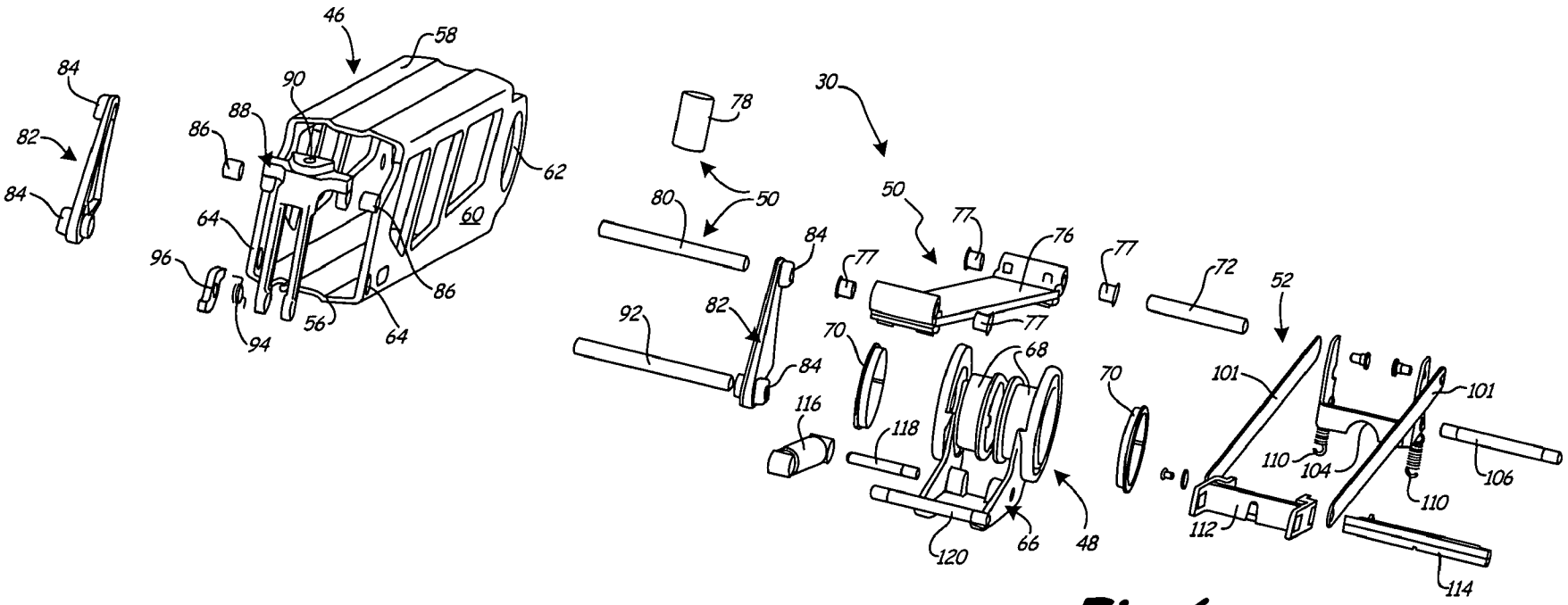
FIG. 6 is an exploded view of the arm assembly from FIG. 2, viewed from the front.
Figure 7A:
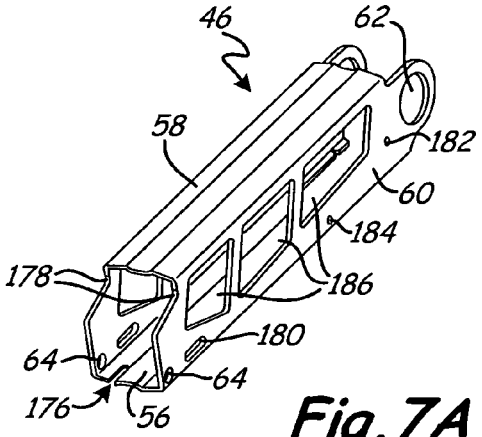
FIG. 7A is a perspective view of the main arm from FIG. 2, viewed from the front.
Figure 7B:
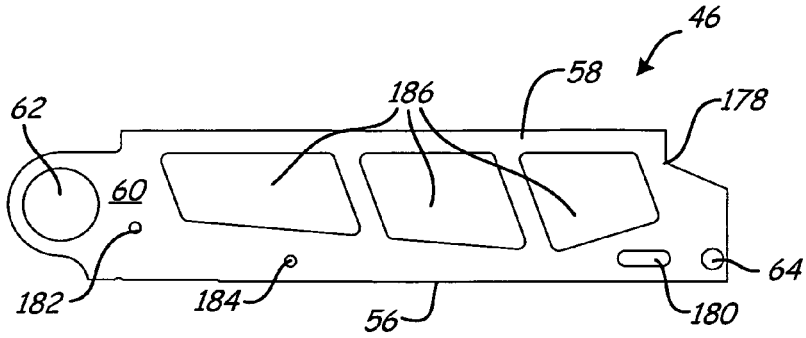
FIG. 7B is a side view of the main arm from FIG. 7A.
Figure 7C:
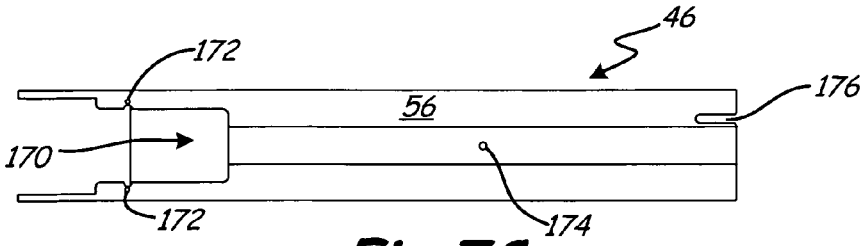
FIG. 7C is a bottom view of the main arm from FIG. 7A.
Figure 7D:
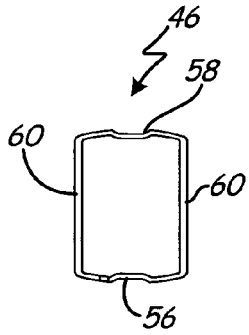
FIG. 7D is an front end view of the main arm from FIG. 7A.
Figure 8A:
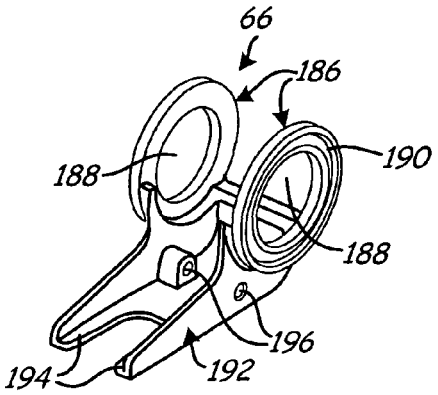
FIG. 8A is a perspective view of the yoke from FIG. 2, viewed from the front.
Figure 8B:
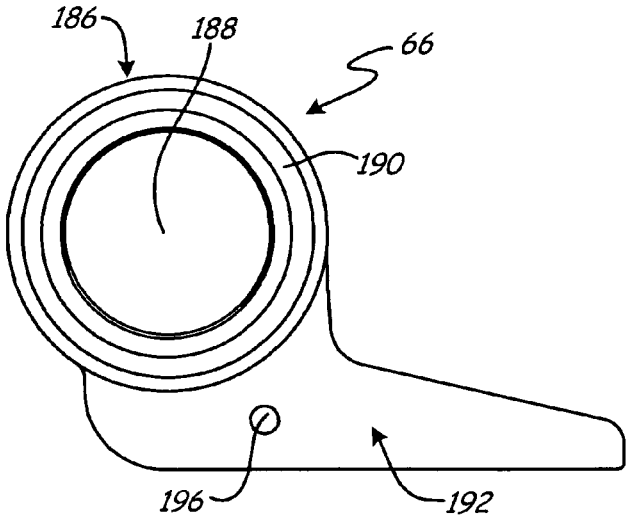
FIG. 8B is a side view of the yoke from FIG. 8A.
Figure 8C:
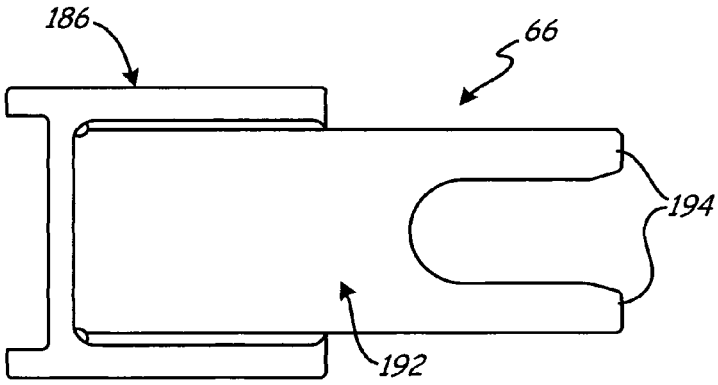
FIG. 8C is a bottom view of the yoke from FIG. 8A.
Figure 8D:
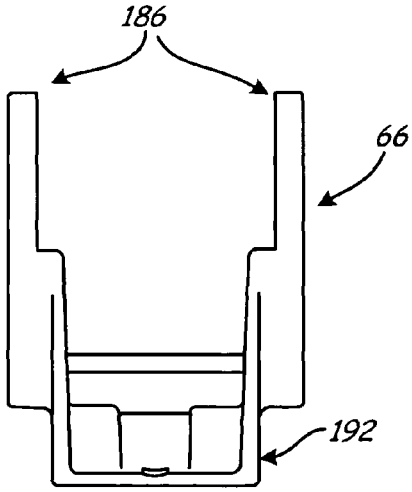
FIG. 8D is a front view of the yoke from FIG. 8A.

FIG. 6 is an exploded front perspective view of an embodiment of the main arm assembly 30, which includes the main arm 46, the rear pivot mechanism 48, the linkage assembly 50, the latch system 52 and the motion control device 54.

A. The Main Arm 46

FIGS. 7A to 7D show different views of an embodiment of the main arm 46. In addition to the bottom wall 56, the top wall 58, the side walls 60, the rear pivot mechanism apertures 62, and the lower front apertures 64, the main arm 46 includes a lower cutaway 170, spring apertures 172, a stop aperture 174, a safety latch slot 176, stop portions 178, front latch slots 180, latch thru holes 182, motion control device thru holes 184, and cutouts 186.

In FIGS. 7A to 7D, the main arm 46 is a single piece extrusion with a rigid open frame comprised of four interconnected walls. In one embodiment, the main arm 46 is formed of a metallic such as aluminum. The main arm 46 is capable of housing most of the other components of the main arm assembly 36. The bottom wall 56 is disposed below the top wall 58 when the main arm 46 is in the deployed position. The bottom wall 56 is generally rectangular and extends from a rear end adjacent the rear pivot mechanism 48 to a front end adjacent the motor coupling assembly 32. The bottom wall 56 has a number of apertures.

The generally square shaped lower cutaway 170 extends through the rear portion of the bottom wall 56 and receives the yoke 66. The rear portion of the bottom wall 56 extends to either side of the lower cutaway 170 and has spring apertures 172, which receive the extension springs 110. The extension springs 110 connect the rear latch assembly 100 to the main arm 46. The threaded stop aperture 174 extends through the center middle portion of the bottom wall 56. The stop aperture 174 receives a fastener, which secures the leaf spring stop 78 to the interior surface of the bottom wall 56. The safety latch slot 176 extends into the front portion of the bottom wall 56. The safety latch slot 176 is adapted to receive a portion of the safety latch 96 when the motor coupling assembly 32 is removed from the linkage assembly 50.

The bottom wall 56 interconnects with a pair of generally rectangular shaped side walls 60. The side walls 60 extend generally perpendicularly from the bottom wall 56. The side walls 60 extend from the rear of the main arm 46 to the front. The rear portion of the side walls 60 are cantilevered off the end of the bottom wall 56 and the top wall 58. The cantilevered portion has the rear pivot mechanism apertures 62, which receive the rear pivot bushings 70 and rear pivot brackets 68. In a one embodiment, the rear pivot mechanism apertures 62 are between about 1 inch and about 4 inches (about 25.4 mm and about 101.6 mm) in diameter. The pivot mechanism apertures 62 allow the main arm 46 to pivotally rotate about the stationary rear pivot brackets 68.

The side walls 60 include features which allow the main arm 46 to couple with the linkage assembly 50, the front latch assembly 102, and the motion control device 54. More specifically, in one embodiment the stop portion 178 of the upper top front edge of the side walls 60 is adapted to abuttably interface with the upper pin 80 when the main arm 46 is in the deployed position. The front latch slot 180 in the lower front portion of the sidewalls 60 is adapted to receive the latch bar 114, which extends through the front latch slot 180 from the interior of the main arm 46. The front latch slot 180 allows the latch bar 114 to releasably slide into and out of engagement with the locking notch 158 when the main arm 46 is in the deployed position. In FIGS. 7A to 7D, the side walls 60 are configured with latch thru holes 182 and motion control device thru holes 184, which receive pins 106 and 120 to pivotally couple the rear latch assembly 100 and the motion control device 54 to the main arm 46, respectively. In one embodiment, the latch thru holes 182 or motion control device thru holes 184 may be counter bored to receive the head of a fastener (such as fastener 122), which allows the fastener head to be generally flush with the exterior surface of the side walls 60. The lower front portion of the side walls 60 are configured with the lower front apertures 64 to receive the lower pin 92, which pivotally couples the linkage assembly 50 to the main arm. 46. In one embodiment, the side walls 60 have cutouts 186 separated by struts. The cutouts 186 allow the operator to view the interior components of the mount 18, increase the cosmetic appeal of the mount 18, and decrease the weight of the main arm 46.

The side-walls 60 interconnect with the top wall 58. As shown in FIG. 2, the top wall 58 is generally rectangular, and extends longitudinally from an end adjacent the rear pivot mechanism 48 to an end adjacent the motor coupling assembly 32. The walls 50, 52, 54 surround and protect the interior components from damage during operation. The components that extend into or are located in the interior compartment 56 may include the leaf spring 76, the rear latch assembly 100, the front latch assembly 102, and the motion control device 54. In other embodiments of the invention, all or some of these components may be disposed outside the main arm 46.

B. The Rear Pivot Mechanism 48

FIG. 6 shows an exploded front perspective view of the rear pivot mechanism 48, which includes the yoke 66, the rear pivot brackets 68, the rear pivot bushings 70, the rear pivot pin 72, and the fasteners 74. The rear pivot mechanism 48 is secured between the side walls 44 at the rear portion of the base extrusion 46 and pivotally couples the main arm 46 to the base extrusion 46. The rear pivot mechanism 48 also pivotally couples the leaf spring 76 to the base extrusion 46. In one embodiment, the rear pivot mechanism 48 allows the main arm 46 to be rotated approximately 177 degrees between the stowed position and the deployed position.

FIGS. 8A to 8D show an embodiment of the yoke 66, which includes hub receiving portions 186, yoke pivot apertures 188, channels 190, a base portion 192, shaft receiving arms 194 and apertures 196.

In one embodiment, the yoke 66 is symmetrically disposed between the side walls 60 toward the rear portion of the main arm 46. The yoke 66 is configured with two symmetric hub receiving portions 186 having yoke pivot apertures 188. The yoke pivot apertures 188 extend through the hub receiving portions 186, and are adapted to rotatably receive a portion of the rear pivot brackets 68. The yoke 66 is configured to allow the yoke pivot apertures 188 to align with the rear pivot apertures 62 when the main arm 46 is in the deployed position. The outer surfaces of two hub receiving portions 186 are adapted with channels 190, which are capable of receiving the rear pivot bushings 70. The base portion 192 of the yoke 66 contacts the base plate 42 when the main arm 46 is in the deployed position. The base portion 192 is adapted with two symmetric shaft receiving arms 194, which contact the base plate 42 when the main arm 46 is in the deployed position. When the main arm 46 is in the stowed position, the shaft receiving arms 194 project generally vertically and are adapted to receive and retain the shaft 22 of the trolling motor 16. The apertures 196 extend through the base portion 192 and receive the rear knurled pin 118, which interconnects the yoke 66 with the motion control device 54. In one embodiment, the motion control device 54 actuates pivotal rotation of the yoke 66 about an axis defined by the rear pivot brackets 68 during a portion of the rotation of the main arm 46 between the stowed position and the deployed position. In one embodiment, this rotation occurs when the main arm 46 is between the stowed position and about 90 degrees.

Figure 9A:
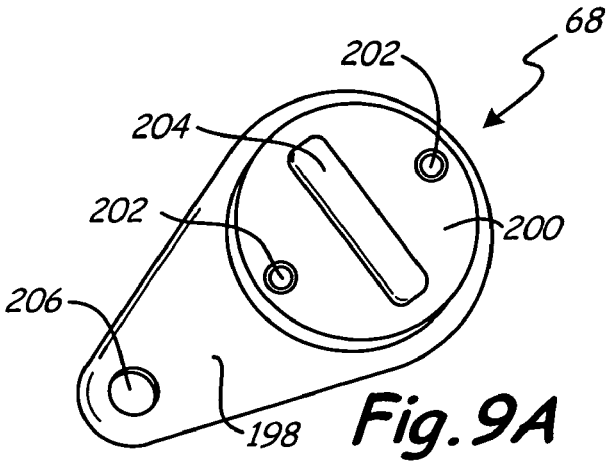
FIG. 9A is a perspective view of the rear pivot bracket from FIG. 2, viewed from the rear.
Figure 9B:
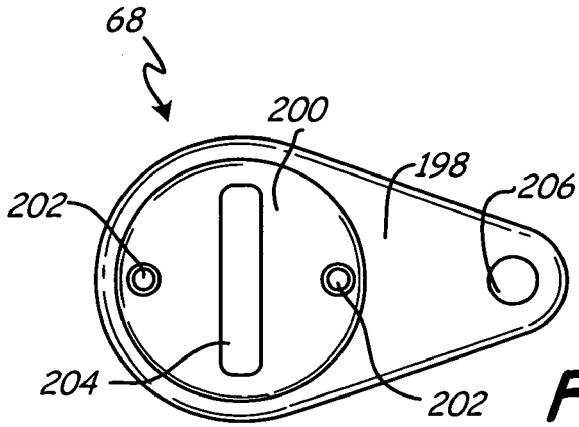
FIG. 9B is a side view of the rear pivot bracket from FIG. 9A.
Figure 9C:
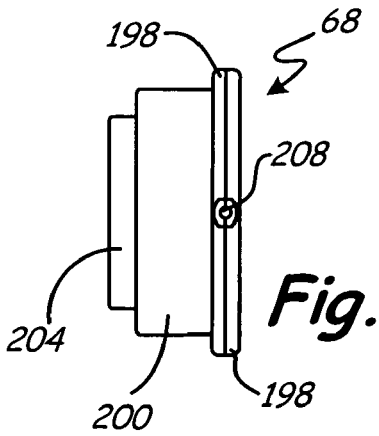
FIG. 9C is a rear view of the rear pivot bracket from FIG. 9A.

FIGS. 9A to 9C show an embodiment of the rear pivot brackets 68, which include fins 198, cylindrical hubs 200, apertures 202, keys 204, rear apertures 206, and retention apertures 208.

In one embodiment, each rear pivot bracket 68 is disposed generally parallel to the other between hub receiving portions 186 of the yoke 66, and each extends outward over the rear end of the base extrusion 34. The fins 198 form the base of the rear pivot brackets 68. The fins 198 interconnect with the cylindrical hubs 200 and taper rearward. The cylindrical hubs 200 allow the rear pivot brackets 68 to extend through the yoke pivot apertures 188 and the rear pivot mechanism apertures 62 such that the exterior surface of the cylindrical hubs 200 are roughly flush with the interior surface of the side walls 44. In one embodiment, the circular projections 138 on the rear pivot brackets 68 (and the pivot apertures 62, 188) are between about 1 inch in diameter and about 4 inches in diameter (about 25.4 mm and about 101.6 mm). The larger diameter of the pivot coupling (the typical mount utilizes pivot pin with a typical diameter of 0.25 inch or 0.50 inch (6.4 mm or 12.7 mm)) between the main arm 46 and the base assembly 28 increases the durability of the pivot coupling. The increased durability of the pivot coupling reduces the likelihood that the coupling may loosen and cause the mount 18 to rattle or make other unpleasant noises during operation of the watercraft 12.

The cylindrical hubs 200 are adapted with threaded apertures 202 to receive the fasteners 74, which fix the rear pivot brackets 68 to the base extrusion 34. The keys 204 extend outward from the cylindrical hubs 200. The keys 204 are adapted to fit into and engage with the slots 156 on the rear side walls 44. The rear apertures 206 extend through the rearward tapered portion of the fins 198. The rear apertures 206 receive the rear pivot pin 72, which allows the leaf spring 76 to pivotally couple to the rear pivot mechanism 48.

The fins 198 may be configured to retain the rear pivot pin 72 non-pivotally or pivotally. In the embodiment shown in FIG. 9C, the rear outward edge of the fin 198 is adapted with a threaded retention aperture 208, which receives a fastener that engages the rear pivot pin 72. The fastener retains the rear pivot pin 72 from pivotally rotating with the leaf spring 76. The bushings 77 allow the leaf spring 76 to pivot on the stationary rear pivot pin 72 as the main arm 46 pivots on the rear pivot brackets 68.

Figure 10A:
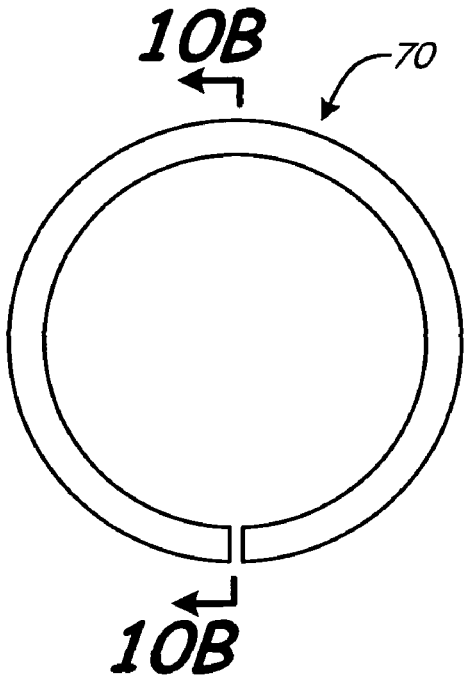
FIG. 10A is a side view of the rear pivot bushing from FIG. 2.
Figure 10B:
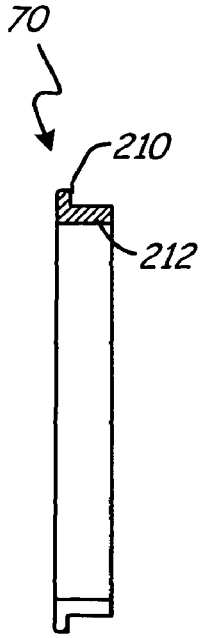
FIG. 10B is a sectional view of the rear pivot bushing from FIG. 10A.

FIGS. 10A and 10B show an embodiment of the rear pivot bushing 70, which includes a lip 210 and an interior projection 212.

The split ring rear pivot bushings 70 are disposed in the rear pivot mechanism apertures 62 on the main arm 46 between the edge of the rear pivot mechanism apertures 62 and the cylindrical hubs 200. More specifically, the annular lip 210 engages the outer surface of the side walls 60. The interior projection 212 interfaces with the edge of the rear pivot mechanism apertures 62 and the annular cylindrical hubs 200. The rear pivot bushing 70 allows the main arm 46 to be pivotally rotated relative to the stationary rear pivot bracket 68.

C. The Linkage Assembly 50

FIG. 6 shows an exploded front perspective view of the linkage assembly 50, which includes the leaf spring 76, the bushings 77, the leaf spring stop 78, the upper pin 80, the front side links 82, the linkage projections 84, the bushings 86, the rope guide 88, the rope hole 90, the lower pin 92, the torsion spring 94, the safety latch 96, and the washer 98. The linkage assembly 50 is disposed adjacent to (and pivotally couples with) the front portion of the main arm 46, and extends through the main arm 46 to pivotally couple to the rear pivot mechanism 48. The linkage assembly 50 and the motor coupling assembly 32 are adapted to removably interconnect.

Figure 11A:
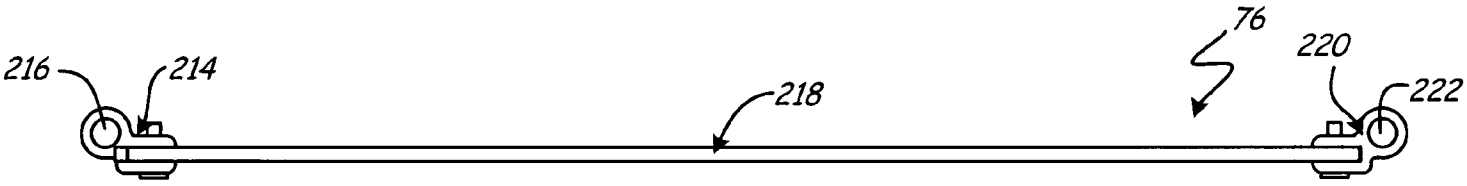
FIG. 11A is a side view of the leaf spring from FIG. 2.
Figure 11B:
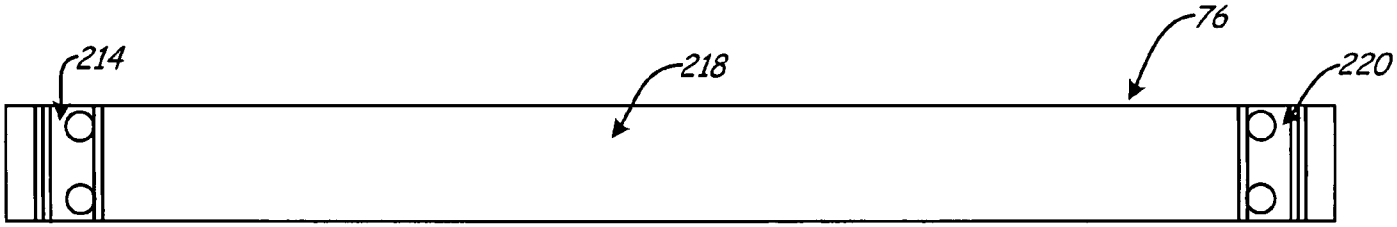
FIG. 11B is a bottom view of the leaf spring from FIG. 11A.

FIGS. 11A and 11B show the leaf spring 76, which includes a rear portion 214, a rear aperture 216, a member 218, a front portion 220, and a front aperture 222.

The rear portion 214 is adapted with the rear aperture 216 to receive the rear pivot pin 72 and the bushings 77, which pivotally couple the leaf spring 76 to the rear pivot mechanism 48. The member 218 interconnects with the rear portion 214 and extends through the open frame of the main arm 46. In one embodiment, the member 218 may flexibly bow to contact the leaf spring stop 78 when the main arm 46 is in the stowed position. The front portion 220 interconnects with the member 218 and is adapted with the front aperture 222 to receive the upper pin 80 and the bushings 77, which pivotally couple the leaf spring 76 to the remainder of the linkage assembly 50. The leaf spring 76 actuates pivotal rotation of the remainder of the linkage assembly 50 (and the motor coupling assembly 32) about the pivot coupling between the main arm 46 and the linkage assembly 50. The leaf spring 76 rotates the remainder of linkage assembly 50 (and the motor coupling assembly 32) from the generally vertical position when in the stowed position, to the generally horizontal position in the deployed position.

FIG. 6 shows the front side links 82, which include the linkage projections 84. The two front side links 82 receive the ends of the upper pin 80 and extend downward and forward generally parallel to each other to receive the lower pin 92. More specifically, the longitudinally and vertically offset trapezoidal linkage projections 84 are adapted to receive the lower and upper pins 80, 92. The linkage projections 84 extend outwards from the exterior side surface of the front side links 82. In one embodiment, the linkage projections 84 are selectively sized and geometrically disposed to interlock with the recesses 142 on the motor coupling assembly 32.

Figure 12A:
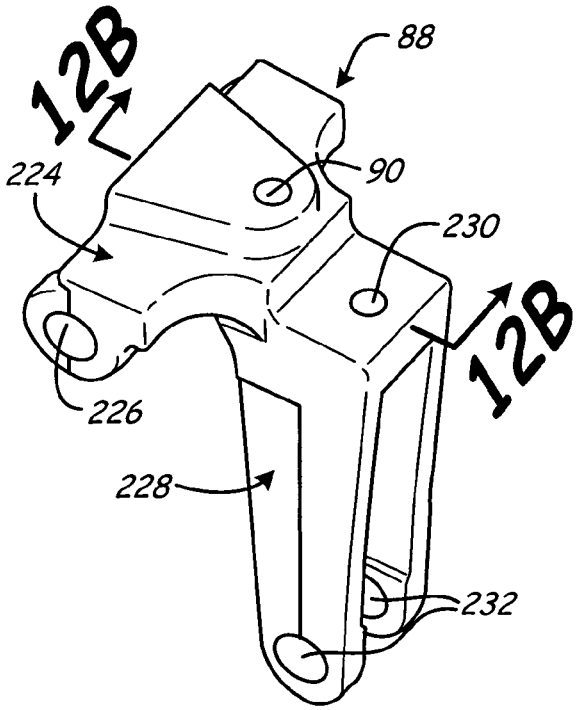
FIG. 12A is a perspective view of the rope guide from FIG. 2, viewed from the side.
Figure 12B:
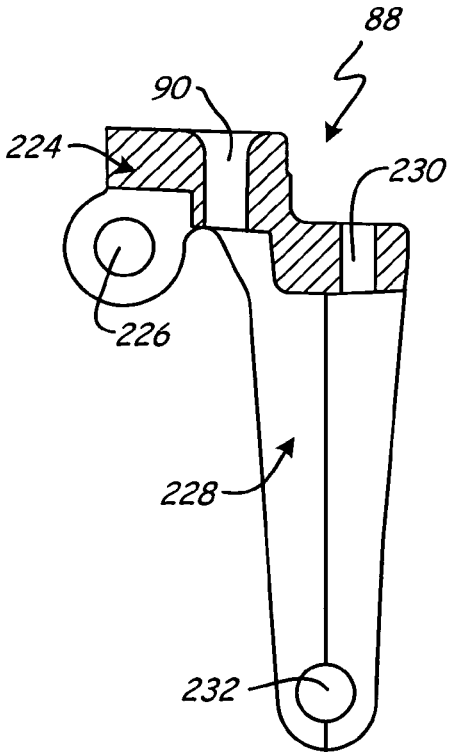
FIG. 12B is a side sectional view of the rope guide from FIG. 12A.

FIGS. 12A and 12B show an embodiment of the rope guide 88, which in addition to the rope hole 90, includes an upper portion 224, upper apertures 226, lower members 228, a motor coupling aperture 230, and lower apertures 232.

The upper portion 224 of the rope guide 88 is separated from the front side links 82 along the length of the upper pin 80 by the bushings 86. The upper apertures 226 pivotally receive the upper pin 80. The upper portion 224 is disposed symmetrically over the front portion 220 and extends down to receive the upper pin 80 to either side of the front portion 220 of the leaf spring 76. The rope hole 90 extends downward through the upper portion 224. The rope hole 90 is adapted to receive the rope 14. The upper portion 224 extends forward and interconnects with the lower members 228. The two lower members 228 extend downward generally parallel to each other to receive the lower pin 92. In one embodiment, the threaded motor coupling aperture 230 receives the fastener 138, which secures the motor coupling assembly 32 to the linkage assembly 50. The lower apertures 232 receive the lower pin 92, which allows the rope guide 88 to pivotally couple with the main arm 46.

Figure 13A:
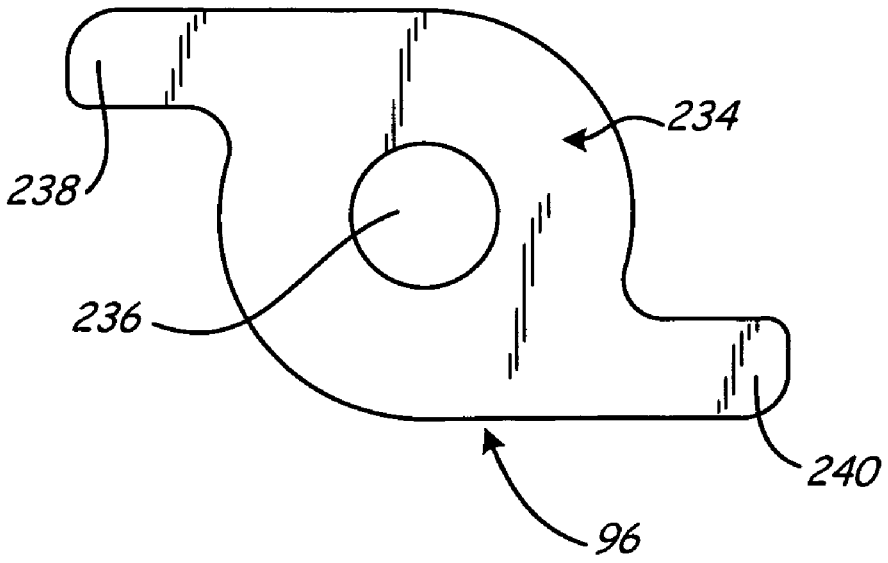
FIG. 13A is a side view of the safety latch from FIG. 2.
Figure 13B:
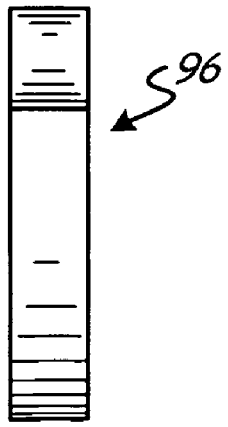
FIG. 13B is a front end view of the safety latch from FIG. 13A.

FIGS. 13A and 13B show front and side views of an embodiment of the safety latch 96, which includes a main body 234, an aperture 236, a rearward nose 238, and a forward nose 240.

In one embodiment, the safety latch 96 is disposed on the lower pin 92 adjacent one of the lower members 228. The cylindrical main body 234 surrounds the lower pin 92. The aperture 236 pivotally receives the lower pin 92. The rearward nose 238 extends from the main body 234 and engages the torsion spring 94. The forward nose 240 extends from the main body 234 and engages the motor coupling assembly 32 when the motor coupling assembly 32 is mounted on the linkage assembly 50. The torsion spring 94 engages the adjacent lower member 228 to bias the rearward nose 238 into the safety latch slot 176 when the motor coupling assembly 32 is not interconnected with the linkage assembly 50.

D. The Latch System 52

FIG. 6 shows an exploded front perspective view of the latch system 52, which includes the rear latch assembly 100, the latch straps 101, and the front latch assembly 102. The rear latch assembly 100 includes the rear latch bracket 104, the pivot pin 106, the e-clips 108, and the extension springs 110. The front latch assembly 102 is comprised of the latch strap bracket 112 and the latch bar 114. The latch system 52 is configured to releasably engage with the base extrusion 34 to lock the main arm 46 in the deployed position, and to releasably engage with the rear pivot mechanism 48 to lock the main arm 46 in the stowed position. In one embodiment, the operator must actuate the latch system by pulling on the rope 14 before rotating the main arm 46 from either the stowed position or the deployed position. The latch system 100 protects against unintended and potentially harmful rotation of the main arm 46.

Figure 14A:
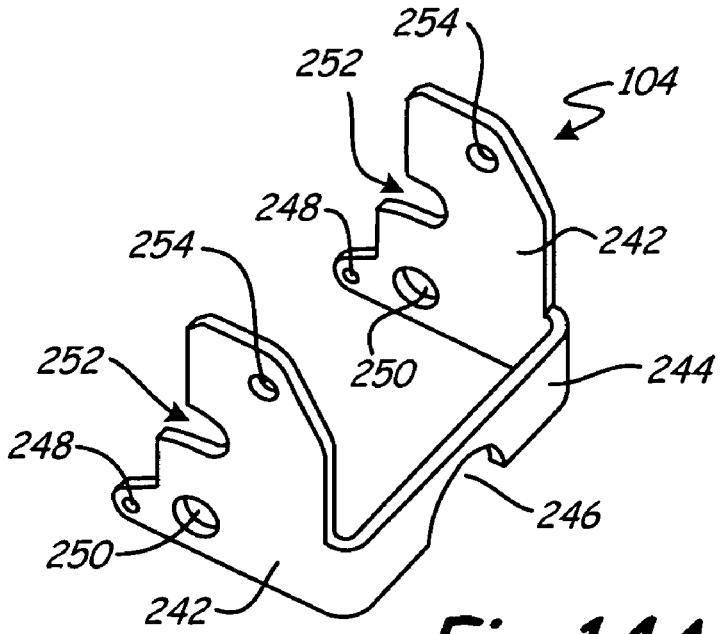
FIG. 14A is a perspective view of the rear latch bracket from FIG. 2, viewed from the front.
Figure 14B:
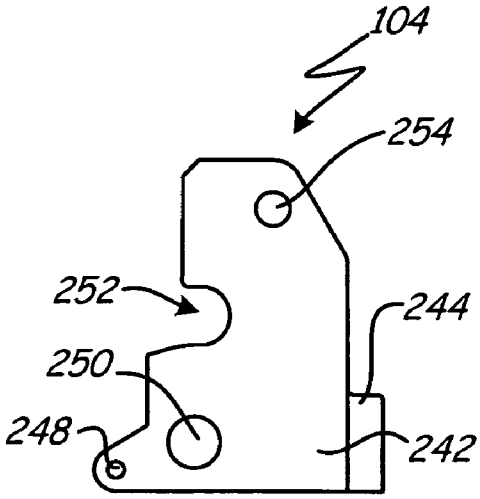
FIG. 14B is a side view of the rear latch bracket from FIG. 14A.

FIGS. 14A and 14B show an embodiment of the rear latch bracket 104, which includes side surfaces 242, a member 244, a cutout 246, spring apertures 248, pivot apertures 250, notches 252, and upper apertures 254.

The rear latch bracket 104 has two symmetrical side surfaces 242 disposed generally parallel to each other. In one embodiment, the side surfaces 242 are disposed adjacent the interior surface of the side walls 60. The side surfaces 242 are interconnected by the member 244. The half circular cutout 246 extends symmetrically through the lower portion of the member 244. The cutout 246 accommodates the barrel of the bias mechanism 116 when the main arm 46 is in the deployed position.

The spring apertures 248 on the lower rear portion of each side surface 242 receive the extension springs 110, which connect the rear latch bracket 104 to the main arm 46 via the apertures 172. The extension springs 110 bias the rear latch assembly 100 and the front latch assembly 102 into releasable engagement. To unlatch the rear latch assembly 100 and the front latch assembly 102 this bias must be overcome by the force of the operator's pull on the rope 14. In one embodiment, the extension springs 110 have an outside diameter of 0.375 inches (9.5 mm), a length of 1.25 inches (31.8 mm), and a spring rate of 30.26 pounds/inch (5.3 N/mm).

The pivot apertures 250 are disposed through the lower rear of the side surfaces 242 and receive the pivot pin 106, which pivotally couples the rear latch bracket 104 to the main arm 46. In one embodiment, the side surfaces 242 are contacted by the e-clips 108, which retain the rear latch bracket 104 symmetrically on the pivot pin 106.

The notches 252 extend through rear edge side surfaces 242 and are configured to engage with the rear pivot pin 72 of the rear pivot mechanism 48 when the main arm 46 is in the stowed position. The notches 252 remain in engagement (biased by the extension springs 110) with the rear pivot pin 72 in the stowed position until the rear latch assembly 100 is pivotally actuated out of engagement by the operator.

The upper apertures 254 receive fasteners, which pivotally couple the rear latch bracket 104 to the latch straps 101. The latch straps 101 interconnect the rear latch bracket 104 with the latch strap bracket 112 (and the rear latch assembly 100 with the front latch assembly 102). The latch straps 101 are adapted to pivotally couple to both the rear latch bracket 104 and latch strap bracket 112. Thus, both the rear latch assembly 100 and the front latch assembly 102 may be actuated simultaneously by the pull of the rope 14.

Figure 15A:
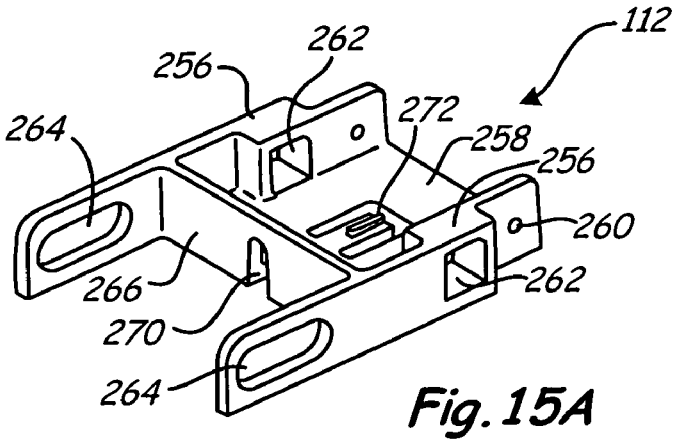
FIG. 15A is a perspective view of the latch strap bracket from FIG. 2, viewed from the front.
Figure 15B:
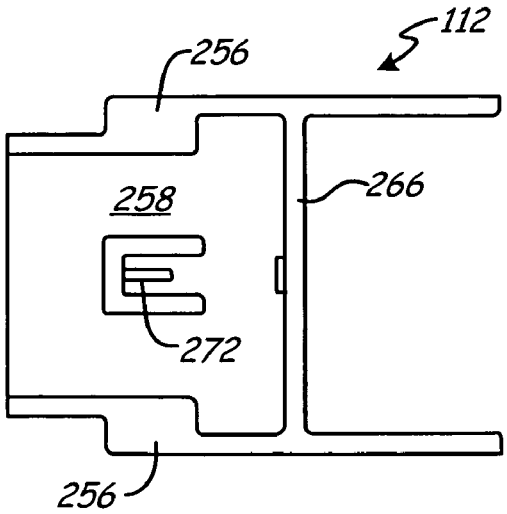
FIG. 15B is a top view of the latch strap bracket from FIG. 15A.
Figure 15C:
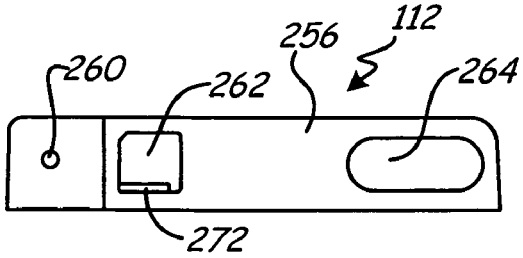
FIG. 15C is a side view of the latch strap bracket from FIG. 15A.

FIGS. 15A to 15C show an embodiment of the latch strap bracket 112, which includes side walls 256, a base platform 258, thru holes 260, square apertures 262, slots 264, an front wall 266, a rope aperture 270, and a groove projection 272.

The latch strap bracket 112 is disposed in the interior of the main arm 46 adjacent the front end of the main arm 46. The symmetrical side walls 256 of latch strap bracket 112 interconnect generally vertically with the base platform 258. Thru holes 260 receive the fasteners, which pivotally couple the latch straps 101 to the latch strap bracket 112. The square apertures 262 are adapted to receive the latch bar 114, which extends outward to either side of the side walls 256. The slots 264 receive the lower pin 92, which allows the latch system 52 to be slidably linearly actuated into and out of engagement with the base extrusion 34 or the rear pivot mechanism 48.

The front wall 266 interconnects to the side walls 256. The rope aperture 270 extends through the front wall 266 and is adapted to receive the rope 14, allowing the rope 14 to interconnect with the latch strap bracket 112. This interconnection may occur, for example, by looping the rope 14 around the aperture 270 and then tying a knot, or by extending the rope 14 through the aperture 270 and then tying a knot that is larger than the rear side of the aperture 270.

The groove projection 272 extends generally vertically from the central portion of the base platform 258 generally parallel with the side walls 256. The groove projection 272 generally aligns horizontally with the square apertures 262. The groove projection 272 engages the latch bar 114 and retains the latch bar 114 from side-to-side movement.

Figure 16A:
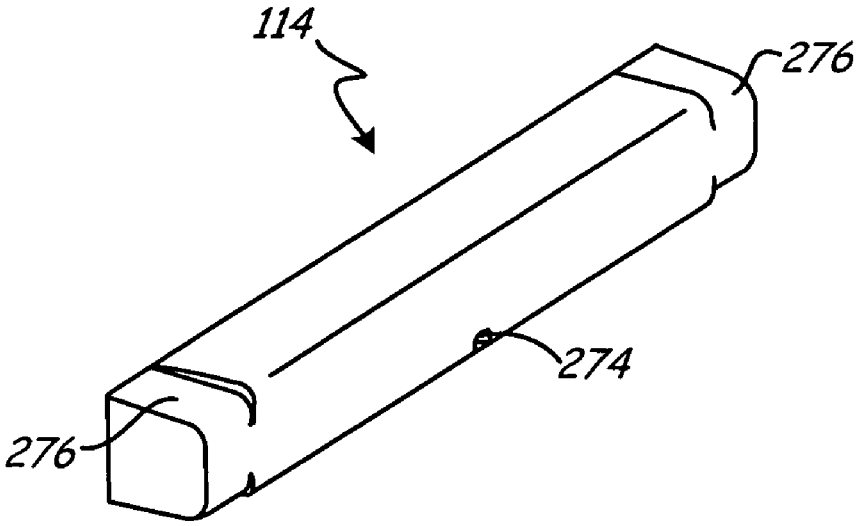
FIG. 16A is a perspective view of the latch bar from FIG. 2, viewed from the top front.
Figure 16B:
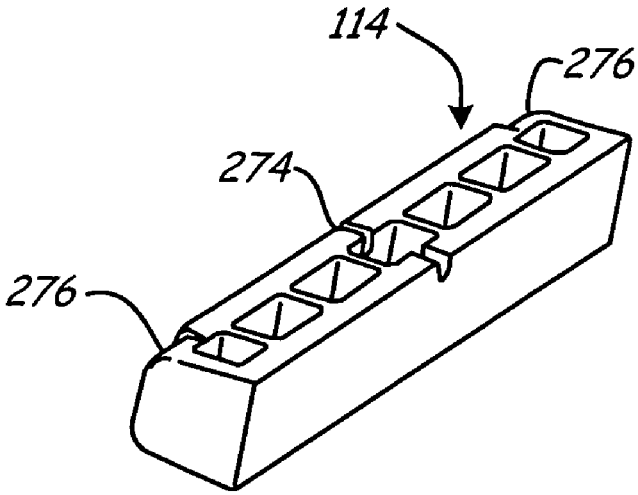
FIG. 16B is a perspective view of the latch bar from FIG. 16B, viewed from the bottom rear.

FIGS. 16A and 16B show an embodiment of the latch bar 114, which includes a groove 274 and end portions 276.

The latch bar 114 is generally square in cross section, and in one embodiment is made of a polymer material, which reduces vibratory noise and can be cost effectively replaced after a period of use. The latch bar 114 extends through the latch strap bracket 112 from one side wall 256 to the other. The groove 274 extends across the center of the bottom surface of the latch bar 114 and engages the groove projection 272. The end portions 276 of the latch bar 114 are rounded and extend from the side walls 256 through the slots 132 in the main arm 46 to engage the locking notches 158 in the base extrusion 34 when the main arm 46 is in the deployed position. The latch bar 114 remains in engagement (biased by the extension springs 110) with the locking notches 158 in the deployed position until the front latch assembly 102 is actuated by the operator. By applying a pulling force to the rope 14 the operator causes the latch strap bracket 112 to slide forward moving the latch bar 114 out of engagement with the locking notches 158.

E. The Motion Control Device 54

FIG. 6 shows an exploded front perspective view of the motion control device 54, which includes the bias mechanism 116, the rear knurled pin 118, the front pivot pin 120, and fasteners 122. The motion control device 54 pivotally couples with the main arm 46 and extends within the main arm 46 to pivotally couple with the rear pivot mechanism 48. The motion control device 54 may be configured to assist, impede, or otherwise bias the movement of the main arm 46 from the stowed position to the deployed position. In one embodiment, the motion control device 54 is configured to assist the operator when the main arm 46 rotates through a part of its movement from the deployed position to the stowed position. In one embodiment, this assisting force is exerted by the motion control device 54 from the deployed position to about 90 degrees. In another one embodiment, the motion control device 54 is configured to impede the rotate of the main arm 46 through a part of its movement from the stowed position to the deployed position. In one embodiment, this impeding force is exerted by the motion control device 54 from about 90 degrees to the deployed position. The motion control device 54 may be configured to exert biasing forces (whether assisting or impeding) on the main arm 46 during other portions of the rotation path of the main arm 46 between the stowed position and the deployed position in other embodiments of the invention.

Figure 17A:
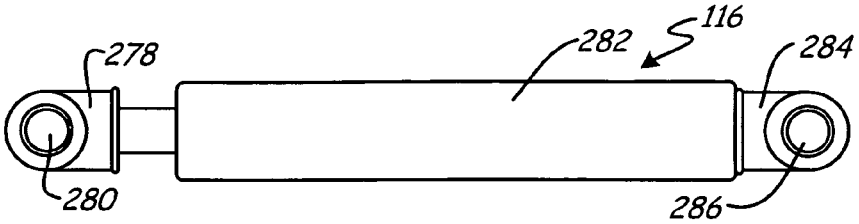
FIG. 17A is a top view of the bias mechanism from FIG. 2.
Figure 17B:
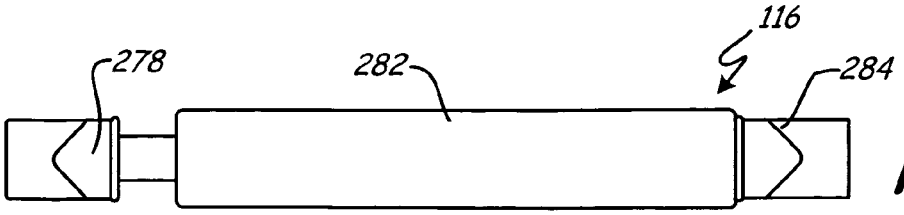
FIG. 17B is a side view of the bias mechanism from FIG. 17A.

FIGS. 17A and 17B show an embodiment of the bias mechanism 116, which includes a rear portion 278, a rear aperture 280, a main body 282, a front portion 284, and a front aperture 286.

The rear portion 178 has the rear aperture 280, which extends through it. The rear aperture 280 receives the rear knurled pin 118, which allows the bias mechanism 116 to the pivotally couple with the rear pivot mechanism 48. The main body 282 interconnects with the rear portion 278, and in the embodiment shown is extendable and retractable from the rear portion 278. In one embodiment, the main body 282 is extendable and retractable only during a portion of the rotation of the main arm 46 between the stowed position and the deployed position. In one embodiment, the bias mechanism 116 exerts its biasing force on the main arm 46 only during the extendable or retractable movement of the main body 282. The main body 282 interconnects with the front portion 284. The front aperture 286 extends through the front portion 284. The front aperture 284 receives the front pivot pin 120, which allows the bias mechanism 116 to pivotally couple with the main arm 46. In one embodiment, the front pivot pin 120 is fixed to the main arm 46 by the fasteners 122.

In one embodiment, the bias mechanism 116 is a gas spring that provides assistance or resistance to the main arm 46. According to an exemplary embodiment, the device 40 is a type of commercially available gas spring (Part No. 15F100260TT) from Engineered Components Products Hardware, LLC. In other embodiments, the bias mechanism may be an air, an elastomer, a spring, a hydraulic device, or a mechanical device.

5. The Motor Coupling Assembly 32

Figure 18:
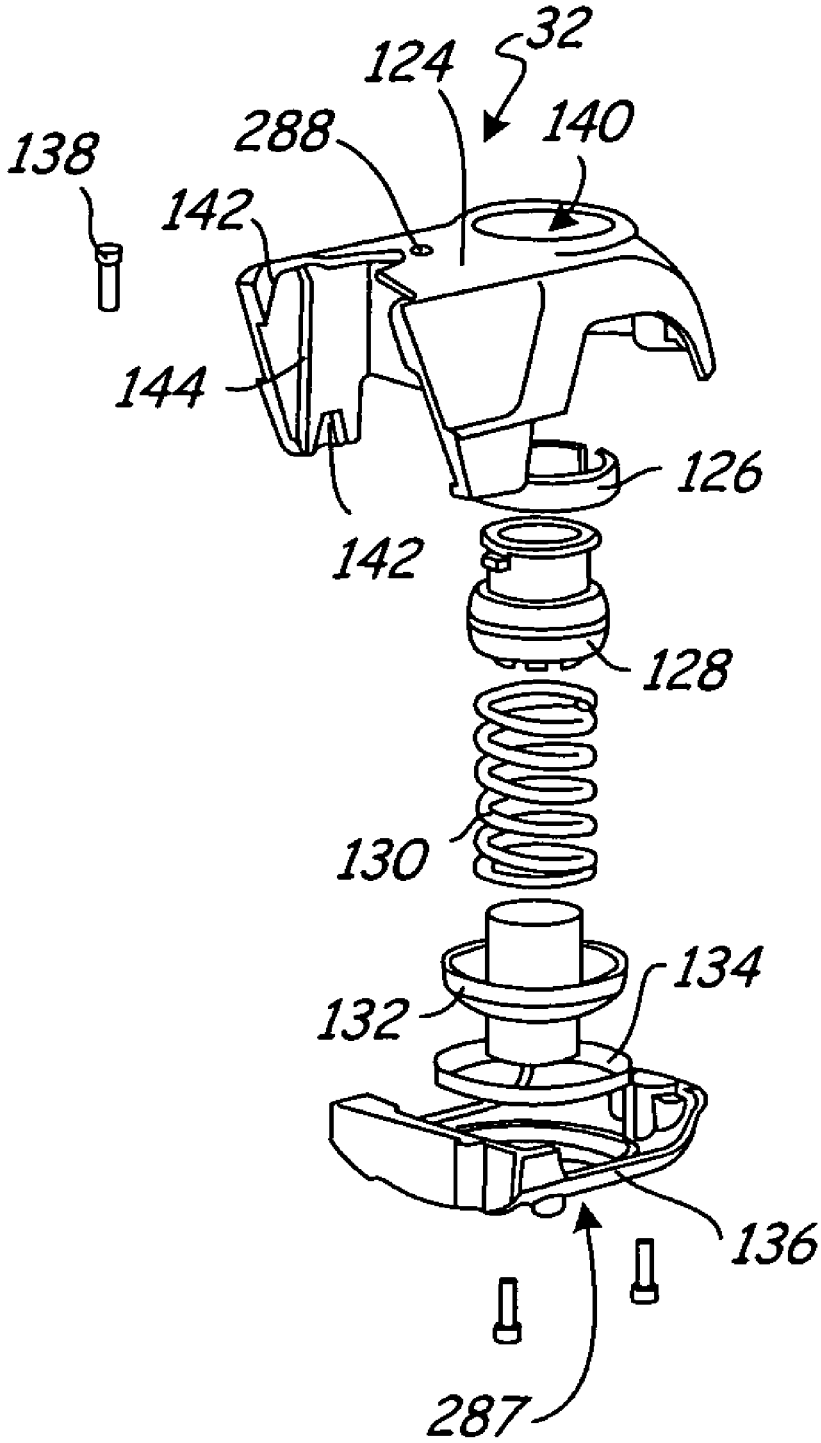
FIG. 18 is an exploded view of the motor coupling assembly from FIG. 2, viewed from the rear.

FIG. 18 shows an embodiment of the motor coupling assembly 32, which includes the upper cover 124, the upper bushing 126, the upper sleeve 128, the spring 130, the lower sleeve 132, the lower bushing 134, the lower cover 136 and the fastener 138. Additionally, the lower cover 132 includes a second orifice 287, and the upper cover 128 includes an aperture 288. The motor coupling assembly 32 is removable from the linkage assembly 50 and the remainder of the mount 18 and is configured to couple with, retain, and guide the shaft 22 of the trolling motor 16.

In FIG. 18, the upper cover 124 extends over and interfaces with the upper bushing 126, and extends around and over the lower portion of the upper sleeve 128. The upper sleeve 128 rotatably interfaces against and aligns with the upper bushing 126 and the spring 130. The upper sleeve 128 rotatably couples with the shaft 22 of the trolling motor 16 when the shaft 22 is inserted in the assembly 32. In one embodiment, the upper sleeve 128 may be configured to selectively tighten and loosen on the: shaft 22.

The spring 130 aligns with and interfaces against both the upper sleeve 128 and the lower sleeve 132. The spring 130 protects and absorbs some of the shock incurred during operation of the trolling motor 16. The lower sleeve 132 aligns with and rotatably interfaces against the spring 130 and the lower bushing 134. The lower sleeve 132 rotatably couples with the shaft 22 of the trolling motor 16. In one embodiment, the lower sleeve 132 may be configured to selectively tighten and loosen on the shaft 22.

The lower cover 136 interconnects with and is fastened to the upper cover 124 to surround the interior components. The orifices 140, 287 in the upper and lower covers 124, 136 vertically align. The other components including the upper bushing 126, the upper sleeve 128, the spring 130, the lower sleeve 132, the lower bushing 134 also vertically align with the orifices 140, 287. The aligned components allow the second orifice 287 to receive the shaft 22 of the trolling motor 16.

In one embodiment, the fastener 138 may be received by the aperture 288, which aligns with the motor coupling aperture 230. In one embodiment, the fastener 138 threads into the motor coupling aperture 230 to removably secure the motor coupling assembly 32 to the linkage assembly 50. Alternatively, (or in addition to the fastener 138) the upper cover 124 may include the recesses 142 and/or the tracks 144 adapted to interface with and mount the motor coupling assembly 32 to the front side links 82.

6. The Mounting of the Motor Coupling Assembly 32

Figure 19:
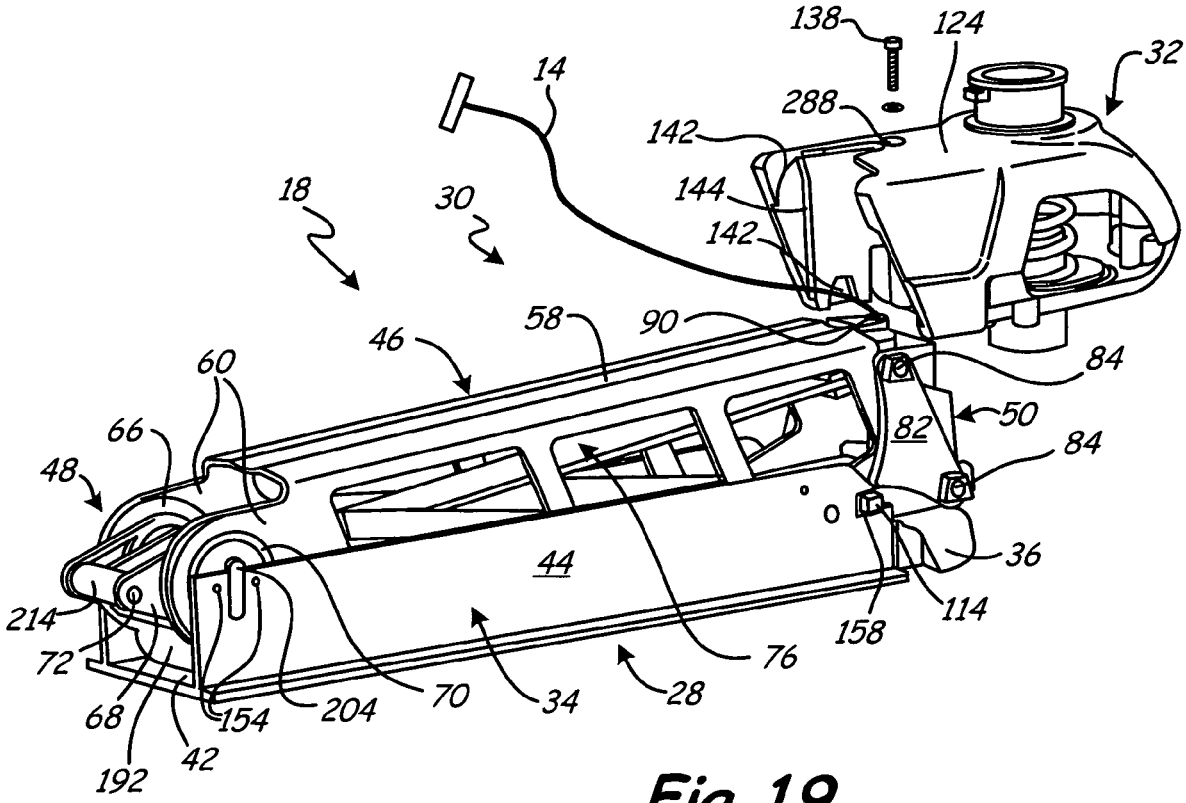
FIG. 19 is a view of the mount from FIG. 1A with the motor coupling assembly, the washer, and the fastener removed from an interlocking position with the mount.

FIG. 19 shows the mount 18 and the features that allow the motor coupling assembly 32 to be removable from the linkage assembly 50 and the mount 18. These features and components include the front side links 82, the linkage projections 84, the fastener 138, the recesses. 142 and the tracks 144. These features and components allow the motor coupling assembly 32 to be quickly disconnected from or connected to the linkage assembly 50 and the mount 18.

In FIG. 19, the motor coupling assembly 32 is adapted with the single aperture 288 which receives the single fastener 138. The fastener 138 passes through the aperture 288 and engages the motor coupling aperture 230 in the rope guide 88 to connect the motor coupling assembly 32 to the linkage assembly 50 and the mount 18. Because conventional linkages between the trolling motor and the mount utilize multiple fasteners, the single fastener 138 allows the operator to more quickly and easily remove or connect the motor coupling assembly 32 to or from the mount 18. In one embodiment, the fastener 138 is the only means used to interconnect the motor coupling assembly 32 with the linkage assembly 50.

By locating the rope hole 90 in the rope guide 88, the motor coupling assembly 32 and trolling motor 16 can be quickly and easily disconnected from or connected to the mount 18 when compared with the conventional bow mount assembly. This is because in the conventional bow mount assembly the rope runs through the main arms to the motor coupling assembly. With the conventional configuration, therefore, the rope must be untied from the interior of the bow mount assembly's main arms before the motor coupling assembly and the trolling motor can be removed from the remainder of the mount.

In FIG. 19, the fastener 138 is not the only means of interconnecting the motor coupling assembly 32 to the linkage assembly 50. In FIG. 19, the fastener 138 is supplemented by the upper cover 124 and the front side links 82, which are configured to interlock using male and female surface profiles. In the embodiment shown in FIG. 19, the interior surface of the upper cover 124 has longitudinally and vertically offset recesses 142. The symmetry of the recesses 142 is mirrored by longitudinally and vertically offset trapezoidal linkage projections 84, which extend outwards from the side surfaces of the front side links 82.

The linkage projections 84 are selectively sized to interlock with the recesses 142. The linkage projections 84 and the recesses 142 interlock to retain the motor coupling assembly 32 from side-to-side or vertical motion when the motor coupling assembly 32 is interconnected to the linkage assembly 50. In other embodiments of the invention, the male and female interlocking surface profiles may be the only means of retaining the motor coupling assembly 32 and connecting the assembly 58 to the mount 18. In other embodiments, the male profile may be on the motor coupling assembly 32 and the female profile may be on the front side links 82. The male/female interlocking profiles allow the operator to quickly remove or connect the motor coupling assembly 32 to or from the mount 18.

In FIG. 19, the interior side surfaces of the upper cover 124 may have generally vertical depressed surfaces that form the tracks 144. The tracks 144 may be used to guide the upper rear linkage projections 84 into interlocking contact with the recesses 142. Thus, to connect the motor coupling assembly 32 to the front side links 82, the motor coupling assembly 32 must initially be disposed above the front side links 82. The upper rear linkage projections 84 are aligned with the tracks 144. The motor coupling assembly 32 is moved vertically downwards toward the front side links 82 until the upper rear linkage projections 84 contact the tracks 144. The tracks 144 guide the linkage projections 84 into interlocking contact with the recesses 142 as the motor coupling assembly 32 is moved downwards onto the front side links 82. The process is reversed to remove the motor coupling assembly 32 from the front side links 82.

7. The Assembled Rear Pivot Mechanism 48

FIG. 19 shows the assembled rear pivot mechanism 48 disposed at the rear of the base assembly 28 and main arm assembly 30. In FIG. 19, the main arm assembly 30 is shown in the deployed position.

In the deployed position, the base portion 192 of the yoke 66 contacts the base plate 42. The yoke 66 is disposed symmetrically between the side walls 44. The yoke 66 receives the cylindrical hubs 200 of the rear pivot bracket 68. The yoke 66 is configured to pivotally rotate on the cylindrical hubs 200 of the rear pivot brackets 68. The rear pivot bushings 70 interface the outer annular surface of the cylindrical hubs 200 and the circular edge of the rear pivot apertures 62. The rear pivot bushings 70 allow the main arm 46 to pivot relative to the fixed rear pivot brackets 68 between the stowed position and the deployed position.

The fasteners 74 (received by the pivot mechanism apertures 154 and threaded into the apertures 202 in rear pivot bracket 68) and slot projection 204 secure the rear pivot brackets 68 in a stationary position to the side walls 44 of the base extrusion 34. The two rear pivot brackets 68 cantilever rearward off the rear end of the side walls 44 generally parallel to one another, and receive the rear pivot pin 72. The rear portion 214 of the leaf spring 76 pivotally couples to the rear pivot pin 72 between the rear pivot brackets 68.

8. The Operation of the Latching System 52

FIG. 19 shows the latch bar 114 extending from the side surfaces 60 of the main arm 46 to releasably engage the locking notches 158. While the first arm 46 is in the deployed position the latch bar 114 remains in locked releasable engagement with the locking notches 158 until the operator actuates the latching system 52 forward by pulling on the rope 14. As will be discussed in greater detail subsequently, while the motor coupling assembly 32 is removed from the linkage assembly 50 (as shown in FIG. 19) the latching system 52 cannot be actuated by the operator's pulling on the rope 14. In FIG. 19, the rope 14 enters the interior of the linkage assembly 50 via the rope hole 90.

Figure 20:
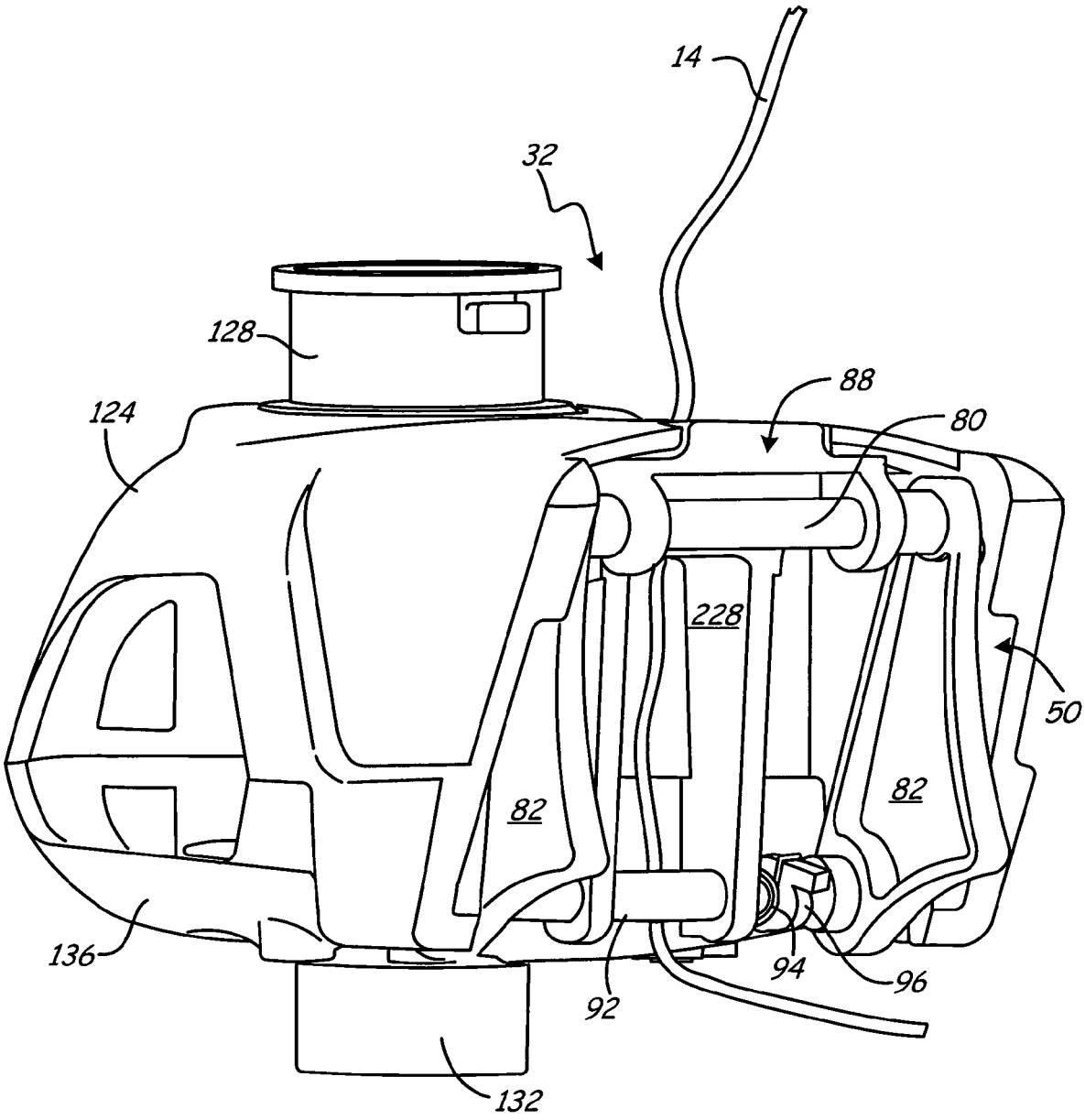
FIG. 20 is a perspective view of the motor coupling assembly from FIG. 19 in an interlocking position with the linkage assembly from FIG. 19, viewed from the rear.

In FIG. 20, the rope 14 is shown entering the interior of the linkage assembly 50, which is engaged with the motor coupling assembly 32. The rope 14 extends generally vertically downward between the lower members 228 of the rope guide 88. The rope 14 wraps over the front facing portion of the lower pin 92 before entering the interior compartment of the main arm 46 to connect generally horizontally to the latch strap bracket 112.

FIG. 20 shows the "latch system lockout," which includes the torsion spring 94 and safety latch 96. In FIG. 20, the motor coupling assembly 32 is mounted on the linkage assembly 50, and the safety latch 96 is disposed on the lower pin 92 adjacent one of the lower members 228. Because the motor coupling assembly 32 is mounted on the linkage assembly 50, the rearward nose 238 of the safety latch 96 engages the torsion spring 94 and points generally rearward in a raised position. In FIG. 20, the forward nose 240 engages the motor coupling assembly. 32 and points generally forward. The torsion spring 94 engages the adjacent lower member 228 and the rearward nose 238 to bias the safety latch 96. If the motor coupling assembly 32 was not mounted to the linkage assembly 50 and engaging the forward nose 240, the safety latch 96 would rotate downward to dispose the rearward nose 238 in the safety latch slot 176. While received in the safety latch slot 176, the rearward nose 238 interferes with the sliding movement of the latch strap bracket 112 so that the main arm 46 cannot be unlatched from either the stowed position or the deployed position.

Figure 21A:
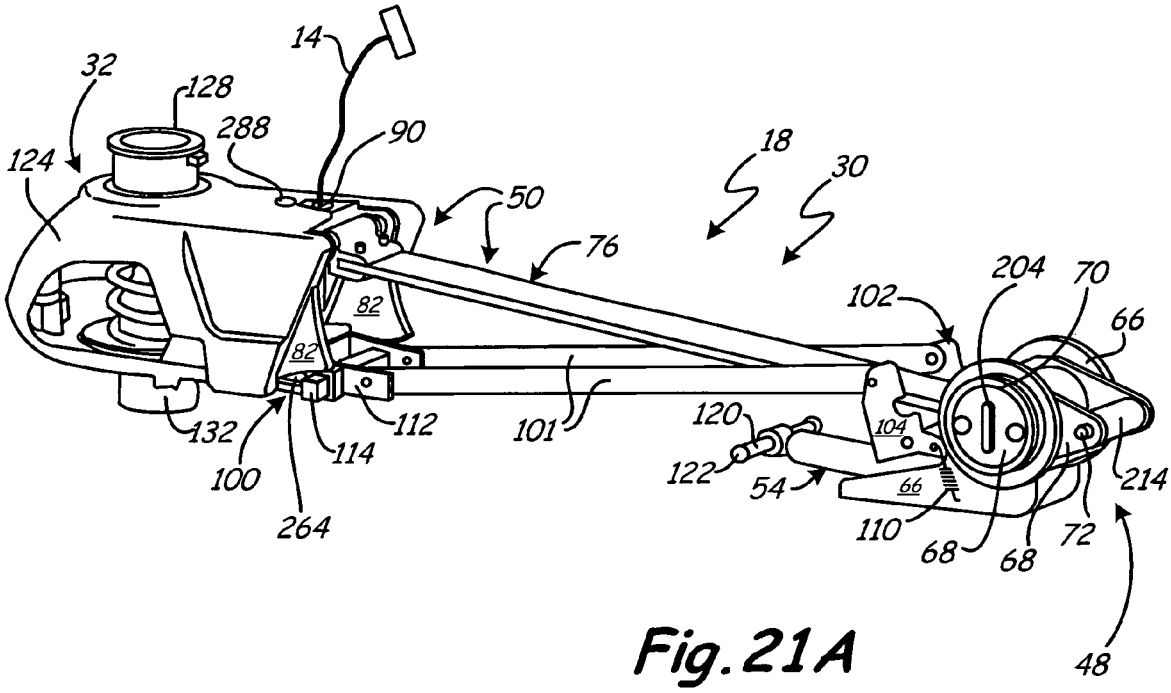
FIG. 21A is a perspective view of the mount from FIG. 1A with the main arm and the base assembly suppressed to show the linkage assembly, the motion control device, and the latch system, viewed from the side.

FIG. 21A shows the components of the latching system 52 in the deployed position with the base assembly 28 and main arm 46 suppressed (i.e. not shown). In FIG. 21A, the rope 14 generally horizontally interconnects with the latch strap bracket 112. The slots 264 engage the lower pin 92 to transfer the pulling motion that the operator exerts on the rope 14 to a generally horizontal linear motion. When the main arm 46 is in the deployed position and the operator has not actuated the rope 14, the extension springs 110 bias the latch bar 114 into engagement with the locking notches 158. When actuated, the horizontal (relative to the deck of the watercraft 12) linear motion of the rope 14 overcomes the bias of the extension springs 110 to unlock the front latch assembly 102 by disengaging the latch bar 114 from the locking notches 158 on the base extrusion 34.

Figure 21B:
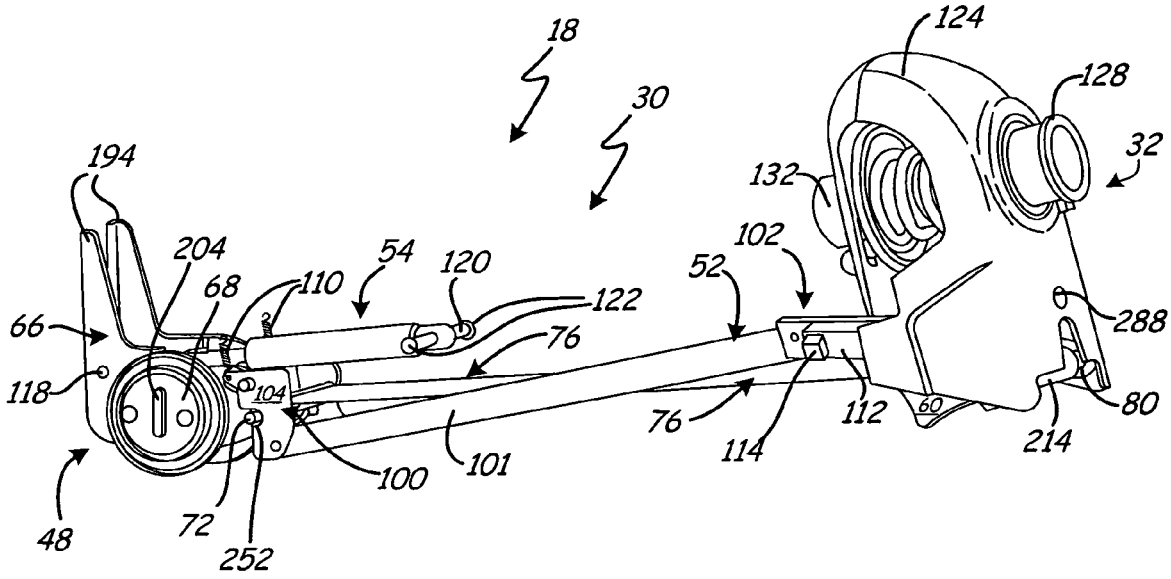
FIG. 21B is a perspective view of the mount from FIG. 1B with the main arm and the base assembly suppressed to show the linkage assembly, the motion control device, and the latch system, viewed from the side.

FIG. 21B shows the components of the latching system 52 in the stowed position. In this position, the rear latch bracket 104 notches 252 engage the rear pivot pin 72. The locking notches 98 remain in engagement (biased by the extension springs 110) with the rear pivot pin 72 in the stowed position until the rear latch assembly 100 is pivotally actuated out of engagement by the operator. The rear latch assembly 100 may be actuated out of engagement by a pull of the rope 14; which slides the front latch assembly 102 forward. The sliding motion of the front latch assembly 102 pulls the latch straps 101 forward. The latch straps 101 pivotally couple to the rear latch bracket 104. The rear latch assembly 100 is pulled pivotally forward out of engagement with the rear pivot pin 72 by the latch straps 101.

9. The Operation of the Linkage Assembly 50

FIGS. 21A and 21B show the linkage assembly 50 with the main arm 46 and base assembly 28 suppressed (i.e. not shown). In FIG. 21A, the linkage assembly 50 is shown in the deployed position. In this position, the upper pin 80 couples the leaf spring 76 to the remainder of the linkage assembly 50. To clarify, when this document refers to "the remainder of the linkage assembly" or to "the front portion of the linkage assembly" it is intended to refer to the components of the linkage assembly 50 excluding the leaf spring 76 and the bushings 77. The front portion of the linkage assembly 50 is configured to pivotally couple with the main arm 46 via the lower pin 92. The leaf spring 76 and the main arm 46 are configured to place the upper pin 80 into interference with the stop portions 178 of the main arm 46 when the main arm 46 is in the deployed position. In the deployed position, the main arm 46 and the rear pivot mechanism 48 are configured to place the leaf spring 76 in tension. This tension force causes the leaf spring 76 to exert a resistive force moment on the linkage assembly 50. The force moment actuates the interference engagement between the linkage assembly 50 and the main arm 46, and impedes the rotation of the front portion of the linkage assembly 50 out of the interference engagement (and the motor coupling assembly 32 out of the generally horizontal position). The force moment generated by the leaf spring 76 reduces play at the coupling joint between the linkage assembly 50 and the main arm 46. The reduction in joint play reduces the likelihood of vibratory noise when the mount 18 is in the deployed position.

In another embodiment, the leaf spring 76 and/or the main arm 46 may be selectively configured to position the linkage assembly 52 (and the motor coupling assembly 32) in a position other than the one shown in FIG. 21A. The leaf spring 76 actuates pivotal rotation of the linkage assembly 50 about an axis defined by the lower pin 92 as the main arm 46 rotates between the stowed position and the deployed position.

In FIG. 21B, the linkage assembly 50 is shown in the stowed position. In addition to the main arm 46 and base assembly 28, the guide member 68 has also been suppressed to better show the leaf spring 76. In the stowed position, the front portion of the linkage assembly 50 (and the motor coupling assembly 32) is rotated to the generally vertical position shown. The leaf spring 76 actuates the pivotal rotation of the front portion of the linkage assembly 50 from the interference engagement when the mount 18 is in the deployed position, to the generally vertical position when the mount 18 is in the stowed position. In the stowed position, the upper pin 80 which couples the front portion of the linkage assembly 50 to the front portion 214 of the leaf spring 76 is now disposed near the lower rear portion of the mount 18. In the stowed position, the main arm 46 and the rear pivot mechanism 48 are configured to place the leaf spring 76 in compression. This compressive force causes the leaf spring 76 to exert a resistive force moment on the remainder of the linkage assembly 50. This force moment holds the motor coupling assembly 32 in the generally vertical position shown while the mount 18 remains in the stowed position. The force moment impedes rotation of the front portion of the linkage assembly 50 (and the motor coupling assembly 32) out of the generally vertical position. The force moment generated by the leaf spring 76 reduces play at the coupling joint between the linkage assembly 50 and the main arm 46. The reduction in joint play reduces vibratory noise when the mount 18 is in the stowed position.

In other embodiments, the leaf spring 76 and/or the main arm 46 may be selectively configured to position the front portion of the linkage assembly 50 (and the motor coupling assembly 32) in a position other than the generally vertical position. In one embodiment, the position of the linkage assembly 50 in the stowed position may be determined by the leaf spring stop 78, which acts as a spacer to halt the rotation of the leaf spring 76 inside the main arm 46. In another embodiment, the leaf spring stop 78 may retain the leaf spring 76 from flexibly bowing when the main arm 46 is in the stowed position. In another embodiment of the invention, the leaf spring 76 and/or the leaf spring stop 78 may be disposed outside the interior compartment 56 of the main arm 46.

10. The Operation of the Motion Control Device 54

FIGS. 21A and 21B show the motion control device 54, which extends forward from the rear pivot mechanism 48 toward the motor coupling assembly 32. In FIG. 21A, the bias mechanism 116 pivotally couples to the yoke 66 via the rear knurled pin 118. The bias mechanism 116 extends forward from the yoke 66 to pivotally couple with the front pivot pin 120. In FIG. 21A the bias mechanism 116 is retracted.

In one embodiment, the bias mechanism 116 rotates with the movement of the main arm 46 from the deployed position shown in FIG. 21A to the stowed position shown in FIG. 21B. In one embodiment, the bias mechanism 116 extends for a portion of the movement of the main arm 46 from the deployed position to the stowed position. In one embodiment, the extension of the bias mechanism 116 aids the operator in lifting and rotating the main arm 46. As the main arm 46 reaches about 90 degrees, the bias mechanism 116 becomes fully extended and no longer exerts a biasing force on the main arm 46. After the bias mechanism 116 becomes fully extended the bias mechanism 116 actuates rotation of the yoke 66, which is configured to pivotally rotate on a portion of the rear pivot brackets 68. In one embodiment, when the yoke 66 is not contacting the base plate 42, the bias mechanism 116 exerts no biasing force on the main arm 46.

In the stowed position shown in FIG. 21B, the yoke 66 is not in contact with the base plate 42, and the receiving members 194 of the yoke 66 extend generally vertically. As the main arm 46 begins to rotate from the stowed position to the deployed position, the bias mechanism 116 actuates rotation of the yoke 66 downward toward the base plate 42. In one embodiment, the bias mechanism 116 begins to retract and exert a biasing force on the main arm 46 when the base of the yoke 66 with the receiving members 194 contacts the base plate 42. In another embodiment, the retraction of the bias mechanism 116 exerts a resistive force on the main arm 46. The bias mechanism 116 continues to exert the biasing force while retracting. In one embodiment, the yoke 66 remains in contact with the base plate 42 and the bias mechanism 116 continues to exert the biasing force from about 90 degrees to the deployed position.

11. The Operation of the Rear Pivot Mechanism 48

FIGS. 21A and 21B show the rear pivot mechanism 48 in the stowed position and the deployed position, viewed from the same perspective. In FIG. 21A the receiving members 194 of the yoke 66 are in horizontal contact with the base plate 42, and the yoke 66 is configured to pivotally rotate about and axis defined by the rear pivot brackets 68. As main arm 46 rotates from the deployed position in FIG. 21A, to the stowed position in FIG. 21B, the receiving members 194 pivotally rotate upward off the base plate 42. The pivotal rotation of the yoke 66 is actuated by the motion control device 54. In FIG. 21B, the receiving members 194 of the yoke 66 extend generally vertically to receive the shaft 22 of the trolling motor 16. In FIGS. 21A and 21B, the rear pivot brackets 68 remain in a stationary position fixed to the base extrusion 34. The annular portion of the rear pivot brackets 68 interface with the rear pivot bushings 70, which allows the main arm 46 to pivotally rotate from the deployed position to the stowed position. The rear pivot brackets 68 retain the rear pivot pin 72, which pivotally couples the leaf spring 76 to the rear pivot brackets 68.

12. The Overall Assembly 18

Figure 22:
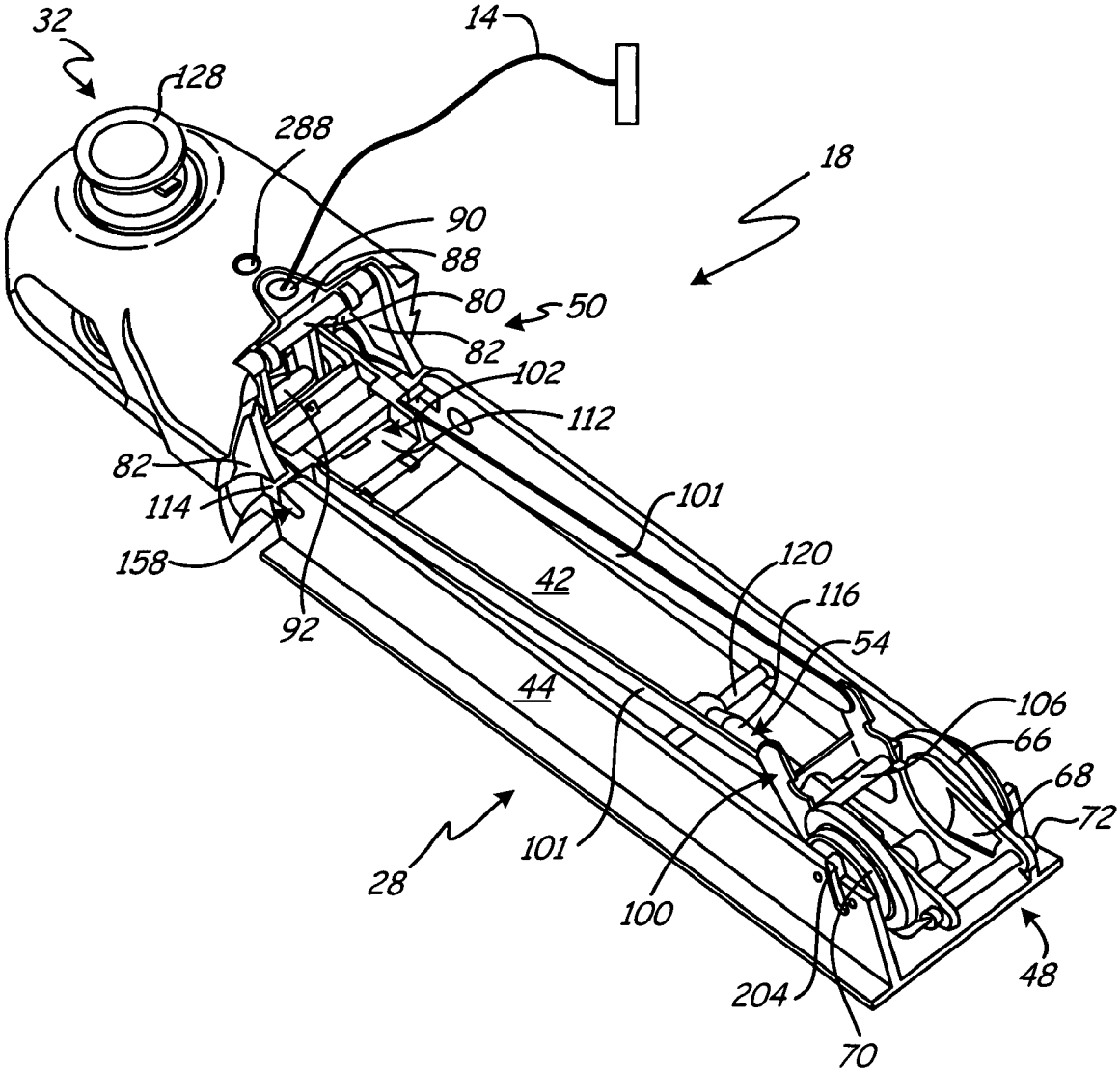
FIG. 22 is an elevated perspective view of the mount from FIG. 1A, viewed from the rear.

FIG. 22 further illustrates the disposition of some of the components of the motor coupling assembly 32, the rear pivot mechanism 48, the linkage assembly 50, the latching system 52, and the motion control device 54, when the main arm 46 is in the deployed position. In FIG. 22, the side plates 40, main arm 46, and leaf spring 76 are suppressed (i.e. not shown).

In FIG. 22, the motor coupling assembly 32 is mounted to the front portion of the linkage assembly 50. The front latch assembly 102 is slightly disengaged from the locking notches 158. More specifically, the latch strap bracket 112 has been slidably actuated forward on the slots 264 around the lower pin 92 such that the latch bar 114 is not in full engaging contact with the locking notches 158.

FIG. 22 also shows some of the improvements to the mount 18. One of these improvements is the large diameter of the rear pivot mechanism 48, which increases the durability of the pivot coupling between the main arm 46 and the base assembly 28. More specifically, in one embodiment of the invention, the hub receiving portions 186 of the yoke 66, the cylindrical hubs 200 of the rear pivot bracket 68, the rear pivot bushings 70, and the rear pivot mechanism apertures 62 of the main arm 46 may all be over about 1 inch (25.4 mm) in diameter. These components are configured to interconnect to form the pivot coupling between the main arm 46 and the base assembly 28. The larger diameter pivot coupling (the typical mount utilizes pivot pin with a typical diameter of 0.25 inch or 0.50 inch (6.4 mm or 12.7 mm)) between the main arm 46 and the base assembly 28 increases the durability of the pivot coupling. The increased durability of the pivot coupling reduces the likelihood that the coupling may loosen and cause the mount 18 to rattle or make other unpleasant noises during operation of the watercraft 12.

FIG. 22 also shows the improved interconnection between the motor coupling assembly 32 and the linkage assembly 50. By locating the rope hole 90 in the rope guide 88, the motor coupling assembly 32 and trolling motor 16 can be quickly and easily disconnected from or connected to the linkage assembly 50 via the single fastener 138 and/or the recesses 142 and/or the tracks 144. The connection and disconnection process is easier than that of the conventional bow mount assembly. This is because in the conventional bow mount assembly the actuation rope runs through the main arms to the motor coupling assembly, and because multiple fasteners are used to connect the motor coupling assembly to the main arms. With the conventional configuration, therefore, the rope must be untied from the interior of the bow mount assembly's main arms and the fasteners loosened and removed before the motor coupling assembly and the trolling motor can be removed from the remainder of the mount.

Figure 23:
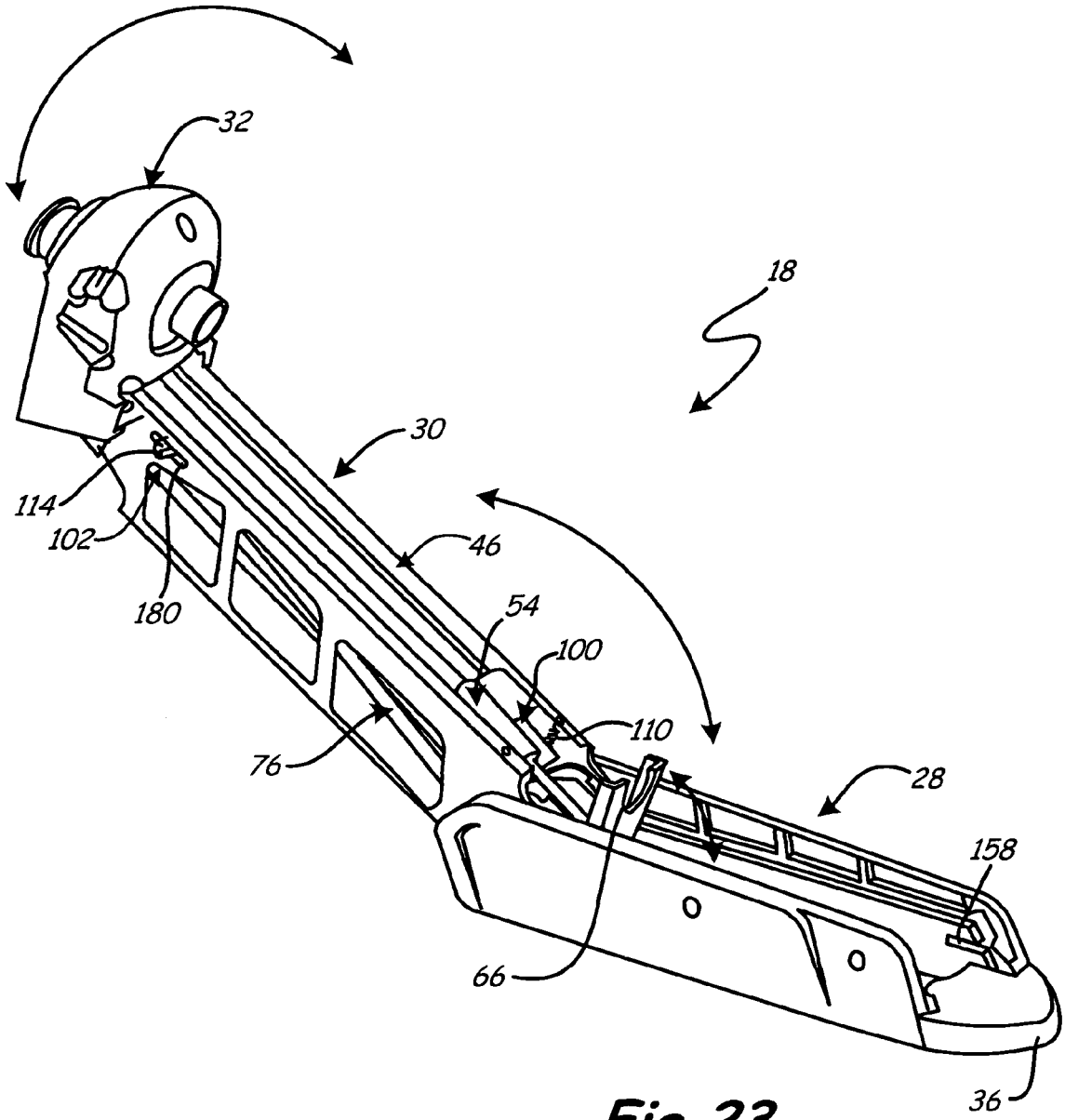
FIG. 23 is a perspective view of the mount shown between the deployed position and the stowed position, viewed from the side.

FIG. 23 shows the rotation of the of the main arm assembly 30, the motor coupling assembly 32 and the yoke 66 as the main arm 46 rotates between the stowed position and the deployed position. FIG. 23 shows some of the improvements to the mount 18. The rigid open frame main arm 46 provides durable light weight protection for the other components of the main arm assembly 30.

The leaf spring 76 is one component of the main arm assembly 30 which extends within the open frame of the main arm 46. The leaf spring 76 provides smooth constant rotational actuation force to the remainder of the linkage assembly 50 as the main arm 46 rotates between the stowed position and the deployed position. The remainder of the linkage assembly 50 interconnects with motor coupling assembly 32 to provide the motor coupling assembly 32 with smooth constant pivotal rotation between the stowed position and the deployed position. In the deployed position and the stowed position, the leaf spring 76 exerts "down pressure" (from the force moment it exerts) on the remainder of the linkage assembly 50 (and motor coupling assembly 32). This "down pressure" reduces play at the coupling joint between the linkage assembly 50 and the main arm 46. The reduction in joint play reduces the likelihood of vibratory noise when the mount 18 is in the stowed and deployed position.

Although the present invention has been described with reference to one embodiments, workers skilled in the art will recognize that changes may be made in form and detail without departing from the spirit and scope of the invention.

The invention claimed is:

1. A mount for securing a trolling motor to a watercraft and for stowing and deploying the motor, the mount comprising:

a base;

a main arm pivotally coupled to the base;

a motor coupling configured to rotatably retain the trolling motor;

a linkage pivotally coupled to the base and pivotally coupled to the main arm and extending within the main arm to contact the motor coupling for actuating rotation of the motor coupling between a first position when the main arm is in a stowed position and a second position when the main arm is in a deployed position; and wherein the linkage includes a leaf spring which extends within the main arm and is in compression when the main arm is in the stowed position and is in tension when the main arm is in the deployed position.

2. The mount of claim 1, wherein the linkage abuts a first portion of the main arm in the deployed position and a second portion of the main arm in the stowed position.

3. The mount of claim 1, wherein the linkage is configured to impede rotation of the motor coupling from the first position and impede rotation of the motor coupling from the second position.

4. The mount of claim 1, wherein the leaf spring bows to contact an interior portion of the main arm when the main arm is in the stowed position.

5. The mount of claim 1, wherein the linkage includes at least one pin which is abuttably interfaced with a portion of the main arm by the leaf spring when the main arm is in the deployed position.

6. The mount of claim 1, further including a pivot mechanism which pivotally attaches the base to the main arm and pivotally attaches the base to the linkage.

7. The mount of claim 1, further comprising a motion control device coupled to the main arm and pivotally coupled to the base and configured to bias rotation of the main arm during a portion of rotation of the main arm between the stowed position and the deployed position.

8. The mount of claim 1, further comprising:

a latch pivotally coupled to the main arm and configured to releasably engage the base when the main arm is in the stowed position;

a latch configured to releasably engage the base when the main arm is in the deployed position; and the first latch couples to the second latch thereby allowing the second latch to actuate the first latch.

9. The mount of claim 8, further comprising a rope interconnected to the latch configured to releasably engage the base when the main arm is in the deployed position and capable of linearly actuating and capable of slidably actuating the latch configured to releasably engage the base when the main arm is in the deployed position out of engagement with the base.

10. A mount for securing a trolling motor to a watercraft and for stowing and deploying the motor, the mount comprising:

a base;

a main arm pivotally coupled to the base;

a motor coupling configured to rotatably retain the trolling motor;

a linkage pivotally coupled to the base and pivotally coupled to the main arm and extending within the main arm to contact the motor coupling for actuating rotation of the motor coupling between a first position when the main arm is in a stowed position and a second position when the main arm is in a deployed position;

a pivot mechanism which pivotally attaches the base to the main arm and pivotally attaches the base to the linkage; and wherein the pivot mechanism includes brackets with hubs having a diameter between about 1 inch (25.4 mm) to about 4 inches (101.6 mm) and a yoke configured to pivotally receive the hubs and the yoke being configured to receive at least a portion of the trolling motor when the main arm is in the stowed position.

11. A mount for securing a trolling motor to a watercraft and for stowing and deploying the motor, the mount comprising:

a base;

an open frame rigid main arm pivotally coupled to the base and configured to rotate between the stowed position and the deployed position;

a motor coupling configured to rotatably retain the trolling motor;

a linkage pivotally coupled to the base and pivotally coupled to the main arm and extending through the open frame of the main arm to secure to the motor coupling for actuating rotation of the motor coupling between a first position when the main arm is in a stowed position and a second position when the main arm is in a deployed position; and wherein the linkage includes a leaf spring which extends within the open frame rigid main arm and is in bowed compression when the open frame main arm is in the stowed position and is in tension when the main arm is in the deployed position.

12. The mount of claim 11, wherein the linkage abuts a first portion of the main arm in the deployed position and a second portion of the main arm in the stowed position.

13. The mount of claim 11, wherein the linkage is configured to impede rotation of the motor coupling from the first position and impede rotation of the motor coupling from the second position.

14. The mount of claim 11, further including a pivot mechanism which pivotally attaches the base to the main arm and pivotally attaches the base to the linkage.

15. A mount for securing a trolling motor to a watercraft and for stowing and deploying the motor, the mount comprising:

a base;

an open frame rigid main arm pivotally coupled to the base and configured to rotate between the stowed position and the deployed position;

a motor coupling configured to rotatably retain the trolling motor;

a linkage pivotally coupled to the base and pivotally coupled to the main arm and extending through the open frame of the main arm to secure to the motor coupling for actuating rotation of the motor coupling between a first position when the main arm is in a stowed position and a second position when the main arm is in a deployed position;

a pivot mechanism which pivotally attaches the base to the main arm and pivotally attaches the base to the linkage; and wherein the pivot mechanism includes brackets with hubs having a diameter between about 1 inch (25.4 mm) to about 4 inches (101.6 mm) and a yoke configured to pivotally receive the hubs and the yoke being configured to receive at least a portion of the trolling motor when the main arm is in the stowed position.

* * * * *